US007929870B2

(12) United States Patent
Aratake et al.

(10) Patent No.: US 7,929,870 B2
(45) Date of Patent: Apr. 19, 2011

(54) IMAGE FORMING APPARATUS WITH A TONER DISPENSING CONTROL UNIT

(75) Inventors: Masayuki Aratake, Ebina (JP); Shunichiro Shishikura, Ebina (JP); Naoya Yamasaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 234 days.

(21) Appl. No.: 12/114,051

(22) Filed: May 2, 2008

(65) Prior Publication Data

US 2009/0022506 A1 Jan. 22, 2009

(30) Foreign Application Priority Data

Jul. 19, 2007 (JP) ..... 2007-188035
Aug. 9, 2007 (JP) ..... 2007-207538

(51) Int. Cl.
*G03G 15/08* (2006.01)
*G03G 15/10* (2006.01)

(52) U.S. Cl. ..... 399/27; 399/58; 399/260

(58) Field of Classification Search ..... 399/27, 399/53, 58, 258, 260
See application file for complete search history.

(56) References Cited

U.S. PATENT DOCUMENTS

| | | | | |
|---|---|---|---|---|
| 5,139,176 | A * | 8/1992 | Reindl et al. | 399/260 X |
| 5,987,271 | A * | 11/1999 | Regelsberger et al. | 399/58 |
| 6,397,019 | B1 * | 5/2002 | Kasuga | 399/27 |
| 6,785,481 | B2 * | 8/2004 | Bray et al. | 399/260 X |
| 7,386,261 | B2 * | 6/2008 | Noguchi et al. | 399/258 |
| 2003/0147661 | A1 * | 8/2003 | Ogata | 399/58 |

FOREIGN PATENT DOCUMENTS

| | | | |
|---|---|---|---|
| JP | 2001-34018 | A | 2/2001 |
| JP | 2002-49234 | A | 2/2002 |

* cited by examiner

*Primary Examiner* — Sandra L Brase
(74) *Attorney, Agent, or Firm* — Sughrue Mion, PLLC

(57) ABSTRACT

An image forming apparatus includes: an image carrying member; a developing unit that develops an electrostatic latent image formed on the image carrying member using toner; a toner dispensing unit that dispenses the toner to the developing unit; and a toner dispense control unit that controls the toner dispensing unit in accordance with an operation speed of the developing unit or the image carrying member.

15 Claims, 12 Drawing Sheets

FIG. 6

※ CASE WHERE OVERRUN TIME IS NOT INCLUDED IN SUBTRACTION VALUE

| PAGE NUMBER | HIGH SPEED (COEFFICIENT = 1.2) | LOW SPEED (COEFFICIENT = 0.8) |
|---|---|---|
| 1 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1000 msec<br>DISPENSE DRIVING TIME = 1000 msec<br>BUFFERING SUBTRACTIVE VALUE = 800 msec<br>CARRY-OVER TIME = 200 msec |
| 2 | BUFFERING TIME = 800 msec<br>DISPENSE DRIVING TIME = 500 msec<br>BUFFERING SUBTRACTIVE VALUE = 600 msec<br>CARRY-OVER TIME = 200 msec | BUFFERING TIME = 1200 msec<br>DISPENSE DRIVING TIME = 1000 msec<br>BUFFERING SUBTRACTIVE VALUE = 800 msec<br>CARRY-OVER TIME = 400 msec |
| 3 | BUFFERING TIME = 1200 msec<br>DISPENSE DRIVING TIME = 1000 msec<br>BUFFERING SUBTRACTIVE VALUE = 1200 msec<br>CARRY-OVER TIME = 0 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 4 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |
| 5 | BUFFERING TIME = 800 msec<br>DISPENSE DRIVING TIME = 500 msec<br>BUFFERING SUBTRACTIVE VALUE = 600 msec<br>CARRY-OVER TIME = 200 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 6 | BUFFERING TIME = 1200 msec<br>DISPENSE DRIVING TIME = 1000 msec<br>BUFFERING SUBTRACTIVE VALUE = 1200 msec<br>CARRY-OVER TIME = 0 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |
| 7 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 8 | BUFFERING TIME = 800 msec<br>DISPENSE DRIVING TIME = 500 msec<br>BUFFERING SUBTRACTIVE VALUE = 600 msec<br>CARRY-OVER TIME = 200 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |
| 9 | BUFFERING TIME = 1200 msec<br>DISPENSE DRIVING TIME = 1000 msec<br>BUFFERING SUBTRACTIVE VALUE = 1200 msec<br>CARRY-OVER TIME = 0 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 10 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |

FIG. 14

※ CASE WHERE OVERRUN TIME IS NOT INCLUDED IN SUBTRACTION VALUE

| PAGE NUMBER | HIGH SPEED (COEFFICIENT = 1.2) | LOW SPEED (COEFFICIENT = 0.8) |
|---|---|---|
| 1 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1000 msec<br>DISPENSE DRIVING TIME = 1000 msec<br>BUFFERING SUBTRACTIVE VALUE = 800 msec<br>CARRY-OVER TIME = 200 msec |
| 2 | BUFFERING TIME = 800 msec<br>DISPENSE DRIVING TIME = 500 msec<br>BUFFERING SUBTRACTIVE VALUE = 600 msec<br>CARRY-OVER TIME = 200 msec | BUFFERING TIME = 1200 msec<br>DISPENSE DRIVING TIME = 1000 msec<br>BUFFERING SUBTRACTIVE VALUE = 800 msec<br>CARRY-OVER TIME = 400 msec |
| 3 | BUFFERING TIME = 1200 msec<br>DISPENSE DRIVING TIME = 1000 msec<br>BUFFERING SUBTRACTIVE VALUE = 1200 msec<br>CARRY-OVER TIME = 0 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 4 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |
| 5 | BUFFERING TIME = 800 msec<br>DISPENSE DRIVING TIME = 500 msec<br>BUFFERING SUBTRACTIVE VALUE = 600 msec<br>CARRY-OVER TIME = 200 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 6 | BUFFERING TIME = 1200 msec<br>DISPENSE DRIVING TIME = 1000 msec<br>BUFFERING SUBTRACTIVE VALUE = 1200 msec<br>CARRY-OVER TIME = 0 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |
| 7 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 8 | BUFFERING TIME = 800 msec<br>DISPENSE DRIVING TIME = 500 msec<br>BUFFERING SUBTRACTIVE VALUE = 600 msec<br>CARRY-OVER TIME = 200 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |
| 9 | BUFFERING TIME = 1200 msec<br>DISPENSE DRIVING TIME = 1000 msec<br>BUFFERING SUBTRACTIVE VALUE = 1200 msec<br>CARRY-OVER TIME = 0 msec | BUFFERING TIME = 1400 msec<br>DISPENSE DRIVING TIME = 1000 msec<br>BUFFERING SUBTRACTIVE VALUE = 800 msec<br>CARRY-OVER TIME = 600 msec |
| 10 | BUFFERING TIME = 1000 msec<br>DISPENSE DRIVING TIME = 1000 msec<br>BUFFERING SUBTRACTIVE VALUE = 1200 msec<br>CARRY-OVER TIME = -200 msec | BUFFERING TIME = 1600 msec<br>DISPENSE DRIVING TIME = 1500 msec<br>BUFFERING SUBTRACTIVE VALUE = 1200 msec<br>CARRY-OVER TIME = 400 msec |

IMAGE FORMING APPARATUS WITH A TONER DISPENSING CONTROL UNIT

CROSS-REFERENCE TO RELATED APPLICATIONS

This application is based on and claims priority under 35 U.S.C. 119 from Japanese Patent Application No. 2007-188035 filed Jul. 19, 2007 and Japanese Patent Application No. 2007-207538 filed Aug. 9, 2007.

BACKGROUND

1. Technical Field

The present invention relates to an image forming apparatus.

2. Related Art

As a method for reducing the cost of image forming apparatuses, there is known a method in which a driving source for a developing unit (hereinafter, referred to as "developing unit driving source") is used in common with a driving source for toner dispense (hereinafter, referred to as "toner dispense driving source"). In recent years, according to various demands, it is a main trend for the image forming apparatuses to have the functionality of a high quality mode or a high productivity mode. There is also a case where plural processing speeds for an image forming operation (hereinafter, referred to as "process speed") are present for each mode.

In a case in which the developing unit driving source is used in common with the toner dispense driving source, and vice versa, and plural process speeds are present, as described above, a toner dispense rate may vary depending on the process speeds. For this reason, it is important to control the toner density to correspond to the varied toner dispense rate. The term, toner dispense rate, refers to an amount of toner for a unit time, dispensed to the developing chamber by the driving of toner dispensing means.

Furthermore, in electrophotographic image forming apparatuses, in order for a developing unit to develop an electrostatic latent image formed on an image carrying member into a toner image, it is necessary to dispense toner to the developing unit by the amount consumed by development. In general, in the case of a developing unit that supplies a bi-component developer composed of toner and carrier onto a developing roll with the developer being agitated in a developing chamber, the developer (toner and carrier) is conveyed and agitated by the rotation of an auger for agitation (hereinafter, referred to as "agitating auger") provided in the developing chamber. When dispensing toner to the developing chamber, toner is dispensed through a toner dispense path or a toner dispense chamber connected to the developing chamber of the developing unit by the driving of a toner dispensing motor.

In such kind of an image forming apparatus, in order to prevent image quality error (such as BCO, overlapping, or toner cloud) while stabilizing an image density, it is important to control a toner density in a developing chamber to be within an intended range.

SUMMARY

According to an aspect of the present invention, an image forming apparatus includes: an image carrying member; a developing unit that develops an electrostatic latent image formed on the image carrying member using toner; a toner dispensing unit that dispenses the toner to the developing unit; and a toner dispense control unit that controls the toner dispensing unit in accordance with an operation speed of the developing unit or the image carrying member.

BRIEF DESCRIPTION OF THE DRAWINGS

Exemplary embodiment of the present invention will be described in detail based on the following figures, wherein:

FIG. 6 is a diagram showing the flow of numeric processing in a toner dispense buffering process;

FIG. 14 is a diagram showing the flow of numeric processing in a toner dispense buffering process;

DETAILED DESCRIPTION

Hereinafter, exemplary embodiments of the present invention will be described in detail with reference to the drawings.

First Embodiment

Figure 1:
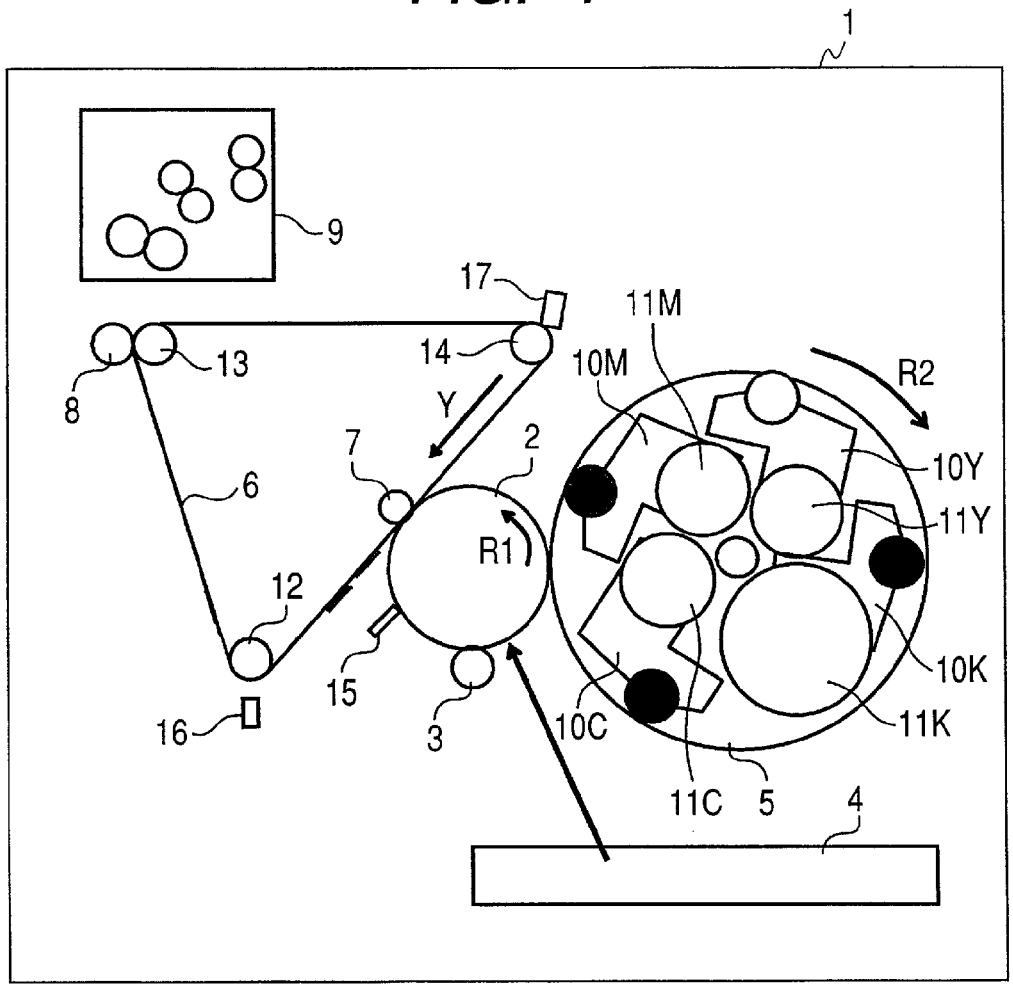
FIG. 1 is a schematic view showing an example of an overall construction of an image forming apparatus according to first and second embodiments of the present invention.

FIG. 1 is a schematic view showing an example of an overall construction of an image forming apparatus according to embodiments of the present invention. The image forming apparatus 1 includes an image carrying member 2, a charging device 3, an exposure device 4, a rotary developing device 5, an intermediate transfer member 6, a primary transfer device 7, a secondary transfer device 8, and a fixing device 9.

During an image forming operation, the image carrying member 2 rotates in the R1 direction at a constant peripheral speed. The image carrying member 2 is constructed by a photosensitive drum. The charging device 3 charges the surface (outer circumference) of the image carrying member 2 to a predetermined potential level. The exposure device 4 forms an electrostatic latent image on the surface of the image carrying member 2 charged to the predetermined potential level by exposure and scanning of laser light, for example.

The rotary developing device 5 develops the electrostatic latent image formed on the surface of the image carrying member 2 using toner, thereby forming a toner image on the image carrying member 2. The rotary developing device 5 has mounted thereon, a yellow developing unit 10Y, a magenta developing unit 10M, a cyan developing unit 10C, and a black developing unit 10K. The rotary developing device 5 rotates in the R2 direction (clockwise direction) with an angle pitch of 90 degrees, thereby switching a development color of the developing unit (10Y, 10M, 10C, and 10K) to be located at an opposing position (hereinafter, referred to as "development position") to the image carrying member 2.

The rotary developing device 5 also has mounted thereon, a toner cartridge 11Y for storing yellow toner, a toner cartridge 11M for storing magenta toner, a toner cartridge 11C for storing cyan toner, and a toner cartridge 11K for storing black toner. Among these, the size (capacity) of the toner cartridge 11K is larger than that of the other toner cartridges 11Y, 11M, and 11C.

The intermediate transfer member 6 is constructed by an endless development belt. The intermediate transfer member 6 is supported by three belt support rolls 12, 13, and 14. The three belt support rolls 12, 13, and 14 cause the intermediate transfer member 6 to move (travel) in the Y direction, which is a process direction of the image forming operation, at a predetermined speed while the intermediate transfer member 6 being supported with a predetermined tension.

The primary transfer device 7 is disposed in an opposing relationship to the image carrying member 2 with the intermediate transfer member 6 disposed therebetween. The primary transfer device 7 transfers the toner image carried on the image carrying member 2 onto the intermediate transfer member 6.

In the vicinity of the image carrying member 2, a cleaning device 15 is provided in addition to the charging device 3 and the rotary developing device 5 described above. The cleaning device 15 is disposed at a position opposite the primary transfer device 7 and the image carrying member 2, for removing toner that remains on the image carrying member 2 without being transferred onto the intermediate transfer member 6.

The secondary transfer device 8 transfers the toner image transferred onto the intermediate transfer member 6 onto a sheet (recording medium) which is not shown. The fixing device 9 applies heat and pressure to the sheet (not shown) having transferred thereto the toner image by the secondary transfer device 8, thereby fixing the toner image onto the sheet.

In the vicinity of the belt support roll 12 of the three belt support rolls 12, 13, and 14, a density detecting sensor 16 is disposed in an opposing relationship to the intermediate transfer member 6 wound around the belt support roll 12. The density detecting sensor 16 detects a density of the toner image transferred onto the intermediate transfer member 6 by the primary transfer device 7, particularly, a density of a toner patch formed for the purpose of density control.

In the vicinity of the belt support roll 14, an intermediate transfer member cleaning device 17 is disposed in an opposing relationship to the intermediate transfer member 6 wound around the belt support roll 14. The intermediate transfer member cleaning device 17 removes the toner that remains on the intermediate transfer member 6 without being transferred onto the sheet by the secondary transfer device 8.

In the image forming apparatus 1 having the afore-mentioned construction, the surface of the image carrying member 2 is charged to a predetermined potential level by the charging device 3, and the charged surface is exposed by the exposure device 4, thereby forming an electrostatic latent image on the surface of the image carrying member 2. The electrostatic latent image is developed into a toner image by the rotary developing device 5.

In the case of forming a monochromatic image of black, the rotary developing device 5 is rotated or stopped so that the black developing unit 10K is located at the development position, and in such a state, the electrostatic latent image is developed into a black toner image by the driving of the developing unit 10K. On the other hand, in the case of forming a polychromatic image of full color, whenever electrostatic latent images for each color are formed on the surface of the image carrying member 2, the rotary developing device 5 is repeatedly rotated or stopped so that the corresponding developing units (10Y, 10M, 10C, and 10K) are sequentially located at the development position, and in each time, the electrostatic latent images are developed into toner images of each color by the driving of the developing units (10Y, 10M, 10C, and 10K) for each color.

The toner image developed by the rotary developing device 5 is transferred by the primary transfer device 7 from the image carrying member 2 onto the intermediate transfer member 6. In the case of forming a polychromatic image, the primary transfer device 7 repeats the transferring of the toner image, whereby the toner images of each color are overlapped and transferred onto the intermediate transfer member 6. The toner image transferred onto the intermediate transfer member 6 is transferred onto a sheet by the secondary transfer device 8 and thereafter fixed onto the sheet by the fixing device 9.

Figure 2:
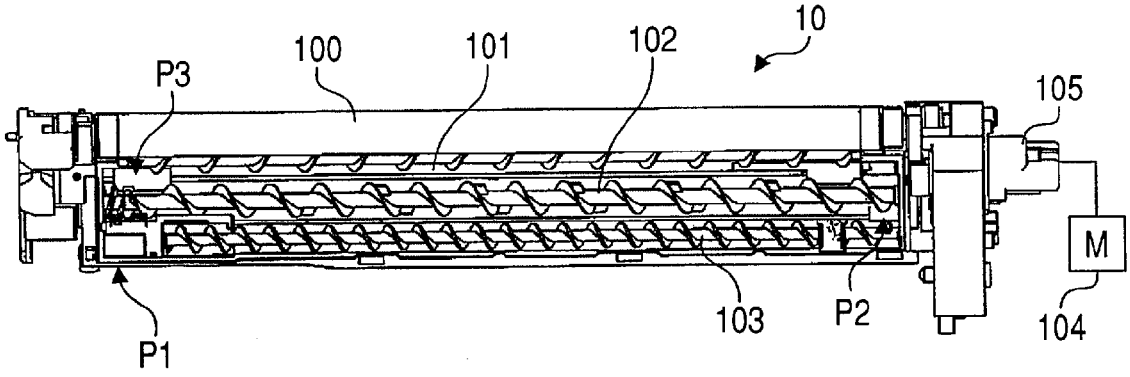
FIG. 2 is a sectional view showing the construction of a developing device.

FIG. 2 is a sectional view showing the construction of the developing unit mounted on the rotary developing device. Since the basic constructions of the above-described developing units 10Y, 10M, 10C, and 10K of each color are the same regardless of the development color, the construction of one developing unit will be described.

The developing unit 10 integrally includes a developing roll 100, a first auger 101, a second auger 102, and a third auger 103. The developing roll 100, the first auger 101, the second auger 102, and the third auger 103 are parallel to each other. The developing roll 100, the first auger 101, and the second auger 102 are provided as the developing means, and the third auger 103 is provided as the toner dispensing means.

The developing roll 100 magnetically absorbs and carries a bi-component developer composed of toner and carrier and conveys the developer in the circumferential direction by rotation of its own roll. The developing roll 100 is constructed for example by a magnet roll and is disposed close to the image carrying member 2 when the developing unit 10 is located at the development position.

The first auger 101 supplies the bi-component developer to the developing roll 100 while conveying the bi-component developer in the axial direction. The second auger 102 charges toner to a predetermined polarity by friction with carrier while agitating and conveying the toner and the carrier. The first and second auger 101 and 102 are disposed in a developing chamber that is partitioned by a partition wall. In the following descriptions, a developing chamber in which the first auger 101 is disposed will be referred to as a first developing chamber, and a developing chamber in which the second auger 102 is disposed will be referred to as a second developing chamber. In this case, the developing roll 100 is disposed to face the first developing chamber.

The third auger 103 conveys toner received from a toner cartridge (not shown) at the P1 position in the drawing, thereby dispensing toner to the second developing chamber. The third auger 103 conveys the toner by its own rotation. For this reason, as the rotation speed of the third auger 103 increases, the amount of toner conveyed increases. The third auger 103 is disposed in a toner dispense chamber that is adjacent to the second developing chamber. The toner dispense chamber is connected to the second developing chamber at the P2 position in the drawing. The second developing chamber is connected to the first developing chamber at the P3 position in the drawing.

The first auger 101, the second auger 102, and the third auger 103 have a spiral protrusion formed therein. These augers 101, 102, and 103 convey developer or toner in the axial direction by their own rotation. The conveyance direction of developer by the first auger 101 is set to the right direction of the drawing, the conveyance direction of developer by the second auger 102 is set to the left direction of the drawing, and the conveyance direction of toner by the third auger 103 is set to the right direction of the drawing.

For this reason, the toner received from the toner cartridge at the P1 position is conveyed in the right direction toward the P2 position in the toner dispense chamber with the rotation of the third auger 103 and then conveyed from the P2 position to the second developing chamber. In the second developing chamber, toner and carrier are agitated by the rotation of the second auger 102, and the agitated bi-component developer is conveyed in the left direction of the drawing toward the P3 position. In this way, the developer conveyed through the second developing chamber is conveyed from the P3 position to the first developing chamber and conveyed in the axial direction (the right direction of the drawing) of the developing roll 100 with the rotation of the first auger 101.

A driving source for rotating the developing roll 100, the first auger 101, and the second auger 102 and a driving source for rotating the third auger 103 are constructed by a common (same) driving source. That is, the developing unit driving source and the toner dispense driving source are used in common. In this invention, a driving motor 104 is used as the common driving source. The connection between the developing unit 10 and the driving motor 104 is carried out by a coupling member 105 when the developing unit 10 is located at the development position. In the case in which the driving motor 104 is used as a common driving source to rotate the developing roll 100, the first auger 101, the second auger 102, and the third auger 103, the developing roll 100 and the augers 101, 102, and 103 rotate at predetermined speeds in proportion to the rotation speed of the driving motor 104.

In a state in which the developing unit 10 and the driving motor 104 are connected by the coupling member 105, by turning on (inputting) and off (stopping) the power transmission from the driving motor 104 using a clutch, for example, the rotation (toner dispensing) of the third auger 103 can be started or stopped at an arbitrary time. Therefore, in the case in which the developing unit 10 is located at the development position to perform a toner dispensing operation, the third auger 103 rotates in the clutch-on state while the third auger 103 stops in the clutch-off state.

In the embodiment of the present invention, although the power transmission from the driving motor 104 to the third auger 103 is interrupted by a clutch, other interruption means other than the clutch may be used.

Figure 3:
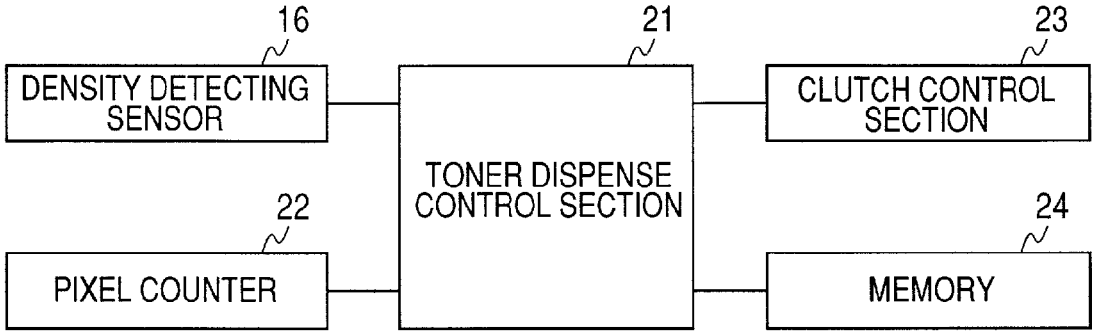
FIG. 3 is a block diagram showing an exemplary functional construction of a toner density control system.

FIG. 3 is a block diagram showing an exemplary functional construction of the image forming apparatus according to the embodiments of the invention, particularly showing an exemplary functional construction of a toner density control system. The toner dispense control section 21 calculates a toner dispense time based on various information (hereinafter, referred to as "toner density control information") received in order to stably control a toner density in the developing chamber and controls the driving of the above-described third auger 103.

The toner dispense control section 21 receives, as an example of the toner density control information, information from the density detecting sensor 16 and information from a pixel counter 22. The information from the density detecting sensor 16 represents a density of the toner patch developed by one of the developing units 10 of the rotary developing device 5. The pixel counter 22 counts the number of pixels (effective pixel number) for one page (one sheet face) of image data. For this reason, the information from the pixel counter 22 represents a pixel coefficient value for one page.

As the toner density control information, an image density for one page (a value obtained by dividing the number of entire pixels in one page by the effective pixel number) or information obtained by a TC (toner concentration) sensor that detects a toner mixture ratio (a mixture ratio of toner to developer) of the bi-component developer in the developing unit 10 may be used. Alternatively or additionally, information obtained by the density detecting sensor that detects the density of the toner patch formed on the surface of the image carrying member 2 may be used.

A clutch control section 23 turns on or off the clutch in accordance with an instruction from the toner dispense control section 21, thereby transmitting a rotation driving force from the driving motor 104 to the third auger 103 or interrupting the transmission. A memory 24 is used to store various data or information related to the toner dispense control.

In the toner density control system having such a construction, the toner dispense control section 21 predicts an amount of toner consumption for one page by computation based on the information on the pixel coefficient value received from the pixel counter 22 and calculates a toner dispense time required to dispense toner by the amount corresponding to the amount of toner consumption. The toner dispense control section 21 controls the toner dispense to the developing chamber by rotating the third auger 103 with reference to the toner dispense time (i.e., by using the time as a control parameter) within a period (hereinafter, referred to as "developing period") in which an arbitrary one of the developing units is located at the development position to perform an developing operation. One developing period is defined as a period from a time point at which the rotation of the rotary developing device 5 stops and a predetermined (arbitrary one) developing unit is located at the development position to a time point at which the rotation of the rotary developing device 5 restarts. Regarding the developing period of any one of the developing units, the rotary developing device 5 rotates 360 degrees during a period from the end of a previous developing period to the start of a subsequent developing period. The above-described type of toner dispense control base on the pixel coefficient value is also referred to as an ICDC (Image Count Dispense Control) type.

The toner dispense control section 21 uses an ADC (Auto Density Control) type toner density control using the density detecting sensor 16 in combination with the ICDC type toner density control using the pixel counter 22. In the case of using the ADC type toner density control in combination, whenever the toner image is developed for a predetermined number of pages, for example, the density of the toner patch is detected by the density detecting sensor 16 and the toner dispense time is calculated base on the detection result. When the density of the toner patch detected by the density detecting sensor 16 is higher than a target reference density, the toner dispense driving time calculated by the ADC type becomes a negative value corresponding to the density difference. When the toner patch density is lower than the reference density, the toner dispense driving time becomes a positive value corresponding to the density difference.

The toner dispense control section 21 calculates the toner dispense time by the following expression (1), in which a toner dispense time calculated by the ICDC type is defined as "ICDC toner dispense time" and a toner dispense time calculated by the ADC type is defined as "ADC toner dispense time."

$$\text{Toner Dispense Time}=\text{ICDC Toner Dispense Time}+\text{ADC Toner Dispense Time} \quad (1)$$

The process speed of an image forming operation is determined by the peripheral speed of the image carrying member 2 at the development position or the movement speed of the intermediate transfer member 6. In the present invention, the peripheral speed of the image carrying member 2 corresponds to an operation speed of the image carrying member 2. For this reason, the process speed of the image forming operation is the same as the operation speed (peripheral speed) of the image carrying member 2 during the image forming operation. The peripheral speed of the developing roll 100 is set to maintain a constant ratio to the peripheral speed of the image carrying member 2. For this reason, the peripheral speed of the developing roll 100 is proportional to the process speed. Therefore, in a case where plural process speeds are present due to difference in the image quality required (set) for an image forming operation, for example, the peripheral speed of the developing roll 100 varies in proportion to the process speed applied to the image forming operation. In the present embodiment, an example will be described in which the process speed of an image forming operation (i.e., the peripheral speed of the image carrying member 2) is switched in three steps in accordance with an image forming condition such as an image quality setting. The three-step process speed is classified into "medium speed" corresponding to a normal (standard) speed, "high speed" higher than "medium speed," and "low speed" lower than "medium speed."

The amount of toner for a unit time, dispensed to the developing chamber by the rotation of the third auger 103, i.e., a toner dispense rate, depends on the rotation speed of the third auger 103. Specifically, as the rotation speed of the third auger 103 increases, the toner dispense rate increases. Since by the common use of the driving sources, the rotation speed of the third auger 103 is proportional to the rotation speed of the developing roll 100, when the process speed applied to the image forming operation varies, the toner dispense rate varies accordingly. That is, the process speed and the toner dispense rate have a proportional relationship. Therefore, even when the third auger 103 is rotated for the same period of time, as the process speed varies, the toner dispense amount varies accordingly. The toner dispense amount refers to the amount of toner dispensed to the developing chamber by the driving of the toner dispensing means (the third auger 103 in the present embodiment).

Here, when a time in which the toner dispensing means is actually driven is defined as a toner dispense driving time, and when the toner dispense driving time is expressed in units of milliseconds [msec]; the toner dispense amount is expressed in units of milligrams [mg]; and the toner dispense rate is expressed in units of milligram/second [mg/sec], the relationship of the following expression (2) is satisfied between them.

$$\text{Toner Dispense Amount}=\text{Toner Dispense Rate}\times 10^{-3}\times\text{Toner Dispense Driving Time} \quad (2)$$

In the expression (2), when the toner dispense driving time is constant, the toner dispense amount increases as the toner dispense rate increases; conversely, the toner dispense amount decreases as the toner dispense rate decreases. As a specific example, when the toner dispense driving time maintains a constant value (=1000 msec), the toner dispense amount becomes 200 mg for the toner dispense rate of 200 mg/sec, while the toner dispense amount becomes 300 mg for the toner dispense rate of 300 mg/sec. For this reason, a difference of 100 mg in the toner dispense amount is caused by the differing toner dispense rate.

In contrast, in the image forming apparatus 1 of the present invention, the toner dispense control section 21 performs a process (details of which will be described later) of changing the driving time (toner dispense driving time) of the third auger 103 using the driving motor 104 in accordance with the process speed that determines the toner dispense rate so that the toner dispense amount does not vary even when the toner dispense rate varies depending on the process speed. In such a process, the driving time of the third auger 103 is changed so as to be relatively short when the process speed (the operation speed of the image carrying member) is relatively high, while the driving time of the third auger 103 is changed so as to be relatively long when the process speed is relatively low. With this, the difference in the toner dispense amount by the differing toner dispense rate decreases compared with the case in which the toner dispense driving time is constant, as described above.

As a specific example, when the toner dispense driving time is 1000 msec for the toner dispense rate of 200 mg/sec and when the toner dispense driving time is 700 msec for the toner dispense rate of 300 mg/sec, the toner dispense amount becomes 200 mg for the toner dispense rate of 200 mg/sec, while the toner dispense amount becomes 210 mg for the toner dispense rate of 300 mg/sec. For this reason, a difference of 10 mg in the toner dispense amount is caused even when the toner dispense rate differs, and the difference amount corresponds to 1/10 of the amount when the toner dispense driving time is constant.

(Toner Dispense Control Process)

Figure 4:
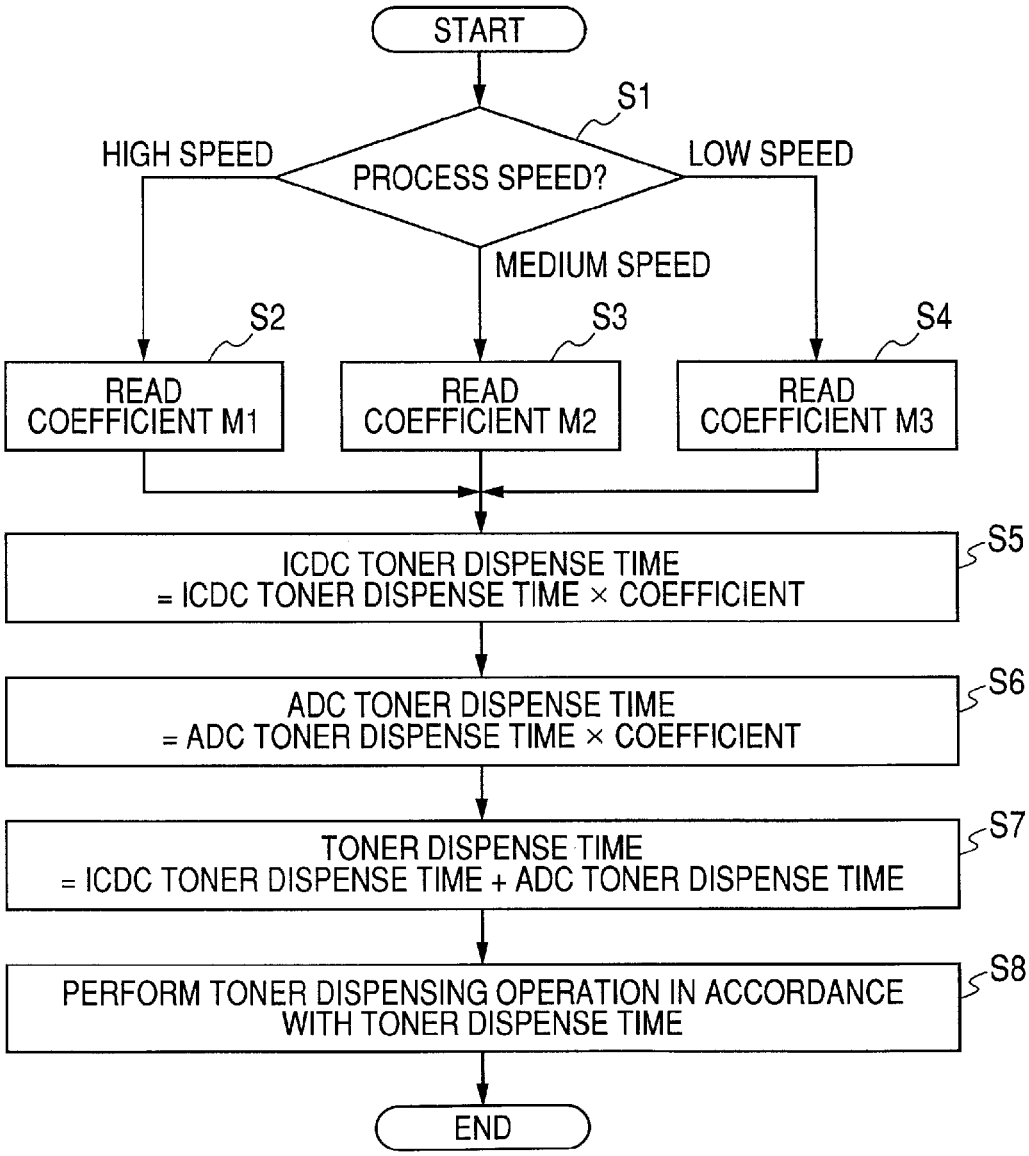
FIG. 4 is a flow chart showing the procedure of a toner dispense control process according to a first embodiment of the present invention.

FIG. 4 is a flow chart showing the procedure of a toner dispense control process according to a first embodiment of the present invention. First, the toner dispense control section 21 determines whether the process speed notified from an image forming control section (not shown) is set to "high speed," "medium speed," or "low speed" (Step S1).

When it is determined in step S1 that the process speed is set to "high speed," a coefficient M1 stored in the memory 24 to correspond to the process speed of "high speed" is read (Step S2). When it is determined that the process speed is set to "medium speed," a coefficient M2 stored in the memory 24 to correspond to the process speed of "medium speed" is read (Step S3). When it is determined that the process speed is set to "low speed," a coefficient M3 stored in the memory 24 to correspond to the process speed of "low speed" is read (Step S4). These three coefficients M1, M2, and M3 are set to satisfy a magnitude relationship: "M1<M2<M3."

Next, the toner dispense control section 21 multiplies the ICDC toner dispense time calculated by the ICDC type with the coefficient M1, M2, or M3 read in Step S2, S3, or S4, thereby correcting the ICDC toner dispense time (Step S5). Specifically, when the process speed is set to "high speed," the ICDC toner dispense time is multiplied with the coefficient M1. When the process speed is set to "medium speed," the ICDC toner dispense time is multiplied with the coefficient M2. When the process speed is set to "low speed," the ICDC toner dispense time is multiplied with the coefficient M3.

Next, the toner dispense control section 21 multiplies the ADC toner dispense time calculated by the ADC type with the coefficient M1, M2, or M3 read in Step S2, S3, or S4, thereby correcting the ADC toner dispense time (Step S6). Specifically, when the process speed is set to "high speed," the ADC toner dispense time is multiplied with the coefficient M1. When the process speed is set to "medium speed," the ADC toner dispense time is multiplied with the coefficient M2. When the process speed is set to "low speed," the ADC toner dispense time is multiplied with the coefficient M3.

Next, the toner dispense control section 21 calculates a toner dispense time applied to a toner dispensing operation based on the expression (1) (Step S7), by using the ICDC toner dispense time corrected in Step S5 and the ADC toner dispense time corrected in Step S6.

Next, the toner dispense control section 21 sends a command to the clutch control section 23 so as to turn on and off the clutch based on the toner dispense time calculated in Step S7, thereby rotating the third auger 103 to execute the toner dispensing operation (Step S8).

In the process flow, when the process speed of the image forming operation is set to "high speed," the toner dispense time (ICDC toner dispense time+ADC toner dispense time) is corrected using the smallest coefficient M1. When the process speed is set to "low speed," the toner dispense time is corrected using the largest coefficient M3.

For this reason, assuming the coefficients are set such that: M1=0.8, M2=1.0, M3=1.2, the toner dispense time is corrected in the direction that it becomes short when the process speed is set to "high speed," while the toner dispense time is corrected in the direction that it becomes long when the process speed is set to "low speed." As a result, in the actual toner dispensing operation, when the process speed is set to "high speed," the toner dispense driving time is changed so as to be shorter than that of the case of "medium speed," while when the process speed is set to "low speed," the toner dispense driving time is changed so as to be longer than that of the case of "medium speed."

As a specific example, a case will be considered in which image data, of which the ICDC toner dispense time calculated based on the number of pixels for one page is 1000 msec in common, are continuously processed into the same development color for 10 pages by rotating the rotary developing device 5. In this case, it is assumed that a coefficient applied for the process speed of "high speed" is set M1=0.8; a coefficient applied for the process speed of "medium speed" is set M2=1.0, and a coefficient applied for the process speed of "low speed" is set M3=1.2.

In such a case, when the process speed is set to "medium speed," since the ICDC toner dispense time is used, as it is, as the toner dispense driving time, the sum of the toner dispense driving time required to process the image data for 10 pages becomes 10000 msec (1000 msec on average for one page). When the process speed is set to "high speed," since the ICDC toner dispense time multiplied with the coefficient M1 (=0.8) is used as the toner dispense driving time, the sum of the toner dispense driving time required to process the image data for 10 pages becomes 8000 msec (800 msec on average for one page). When the process speed is set to "low speed," since the ICDC toner dispense time multiplied with the coefficient M3 (=1.2) is used as the toner dispense driving time, the sum of the toner dispense driving time required to process the image data for 10 pages becomes 12000 msec (1200 msec on average for one page).

For the sake of explanation, it is assumed that the toner dispense rate is 1.2 mg/sec for the process speed of "high speed"; the toner dispense rate is 1.0 mg/sec for the process speed of "medium speed"; and the toner dispense rate is 0.8 mg/sec for the process speed of "low speed." In such a case, in the above example, the sum of the toner dispense amount for 10 pages becomes 9.6 mg (0.96 mg on average for one page) for the process speed of "high speed"; the sum of the toner dispense amount for 10 pages becomes 10 mg (1 mg on average for one page) for the process speed of "medium speed"; and the sum of the toner dispense amount for 10 pages becomes 9.6 mg (0.96 mg on average for one page) for the process speed of "low speed."

In contrast, for example, assuming that the coefficients M1, M2, and M3 are all set to 1.0, the sum of the toner dispense driving time required to process the image data for 10 pages becomes 10000 msec (1000 msec on average for one page) regardless of the process speed. For this reason, the sum of the toner dispense amount for 10 pages becomes 12 mg (1.2 mg on average for one page) for the process speed of "high speed"; the sum of the toner dispense amount for 10 pages becomes 10 mg (1 mg on average for one page) for the process speed of "medium speed"; and the sum of the toner dispense amount for 10 pages becomes 8.0 mg (0.8 mg on average for one page) for the process speed of "low speed."

Therefore, when image data for one page, of which the number of pixels counted by the pixel counter 22 is the same, are printed on a sheet with a differing process speed, even when the toner dispense rate varies with the differing process speed, the toner dispense amount for one page is equalized regardless of the process speed by changing the toner dispense driving time.

However, there is a case in which the toner dispensing operation by the third auger 103 is performed a maximum of n times (n: a natural number not less than 2) with a duration of t within one developing period, considering the agitation or charging properties of toner. In such a case, assuming that the toner dispense driving time t for one toner dispensing operation is defined as a unit toner dispense driving time, an upper limit of the toner dispense driving time that is permitted for one developing period is defined as n×t.

In the case of forming a polychromatic image using the rotary developing device 5, a period in which the developing units 10Y, 10M, 10C, and 10K are located at the development position is restricted. For this reason, if the toner dispense time applied to the toner dispensing operation is greater than the upper limit (n×t), there may be a case that the toner dispensing operation is not completed within the one developing period. In such a case, the toner dispense driving time corresponding to the amount of time that has not been processed in the previous developing period is added to a subsequent developing period of the toner dispensing operation, in which the developing unit of the same color is located again at the development position, thereby supplementing the deficiency in the toner dispense. In the subsequent descriptions, such a process will be referred to as "toner dispense buffering process."

In the toner dispense buffering process, for each of the developing units 10 of each color, a toner dispense buffering time is stored in the memory 24. That is, the toner dispense buffering time is maintained in the memory 24 for each development color of yellow, magenta, cyan, and black. Regarding the developing unit 10 of the corresponding development color, the toner dispense time calculated by the ICDC type or the ADC type is used as an additional value to the toner dispense buffering time, and the driving time (toner dispense driving time) of the third auger 103 is used as a subtractive value from the toner dispense buffering time. In this manner, the toner dispense buffering process is performed while updating the toner dispense buffering time in the memory 24.

(Concept of Toner Dispense Buffering Process)

If the toner dispensing operation is performed a maximum of n times (n: a natural number not less than 2) with a duration of t within one developing period, the number of toner dispensing operations in each of the developing periods is determined based the toner dispense buffering time. Specifically, among the quotient (an integer) and the remainder obtained when the toner dispense buffering time is divided by the value of t, the number of toner dispensing operations is determined by the value of the quotient; the toner dispense driving time corresponding to the determined number is subtracted from the toner dispense buffering time, and the value of the remainder is used as a carry-over to the subsequent period. When the toner dispense buffering time is greater than t×n, the upper limit of the toner dispense driving time, the surplus is used as a carry-over to the subsequent period. When the toner dispense buffering time has a negative value, the toner dispense buffering time is used, as it is, as a carry-over to the subsequent period.

(Example of Toner Dispense Buffering Process)

In a system construction of a toner density control system capable of performing a toner dispensing operation a maximum of 3000 msec (n=6, and t=500 msec) within one developing period, assuming that the toner dispense buffering time stored in the memory before the present developing period starts is 1000 msec, the toner dispensing operation by the third auger 103 is performed twice with a duration of 500 msec in the present developing period. For this reason, the toner dispense buffering time stored in the memory 24 becomes 0 msec since 1000 msec used as the driving time of the third auger 103 in the present developing period is subtracted therefrom.

In contrast, assuming that the toner dispense buffering time before the present developing period starts is 800 msec, the toner dispensing operation by the third auger 103 is performed only once with a duration of 500 msec in the present developing period. For this reason, the toner dispense buffering time stored in the memory 24 becomes 300 msec since 500 msec used as the driving time of the third auger 103 in the present developing period is subtracted therefrom. The amount of time, 300 msec that has not been processed in the present developing period becomes a carry-over to the subsequent period. If the ICDC toner dispense time calculated before the subsequent developing period starts is 800 msec, this amount of time is added to the carry-over (300 msec) from the previous period and included in the subsequent developing period. For this reason, the toner dispense buffering time before the subsequent developing period starts becomes 1100 msec. Therefore, the toner dispensing operation by the third auger 103 is performed twice with a duration of 500 msec in the subsequent developing period.

In a state that the toner dispense buffering time stored in the memory 24 is 300 msec, if the ADC toner dispense time calculated before the present developing period starts is −500 msec, the toner dispense buffering time in the memory 24 becomes −200 msec by the addition of the two toner dispense buffering times. For this reason, the toner dispensing operation by the third auger 103 is not performed in the present developing period. In contrast, in a state that the toner dispense buffering time stored in the memory 24 is 300 msec, if the ADC toner dispense time calculated before the present developing period starts is +200 msec, the toner dispense buffering time in the memory 24 becomes 500 msec by the addition of the two toner dispense buffering times. For this reason, the toner dispensing operation by the third auger 103 is performed only once with a duration of 500 msec in the present developing period.

Second Embodiment

Figure 5:
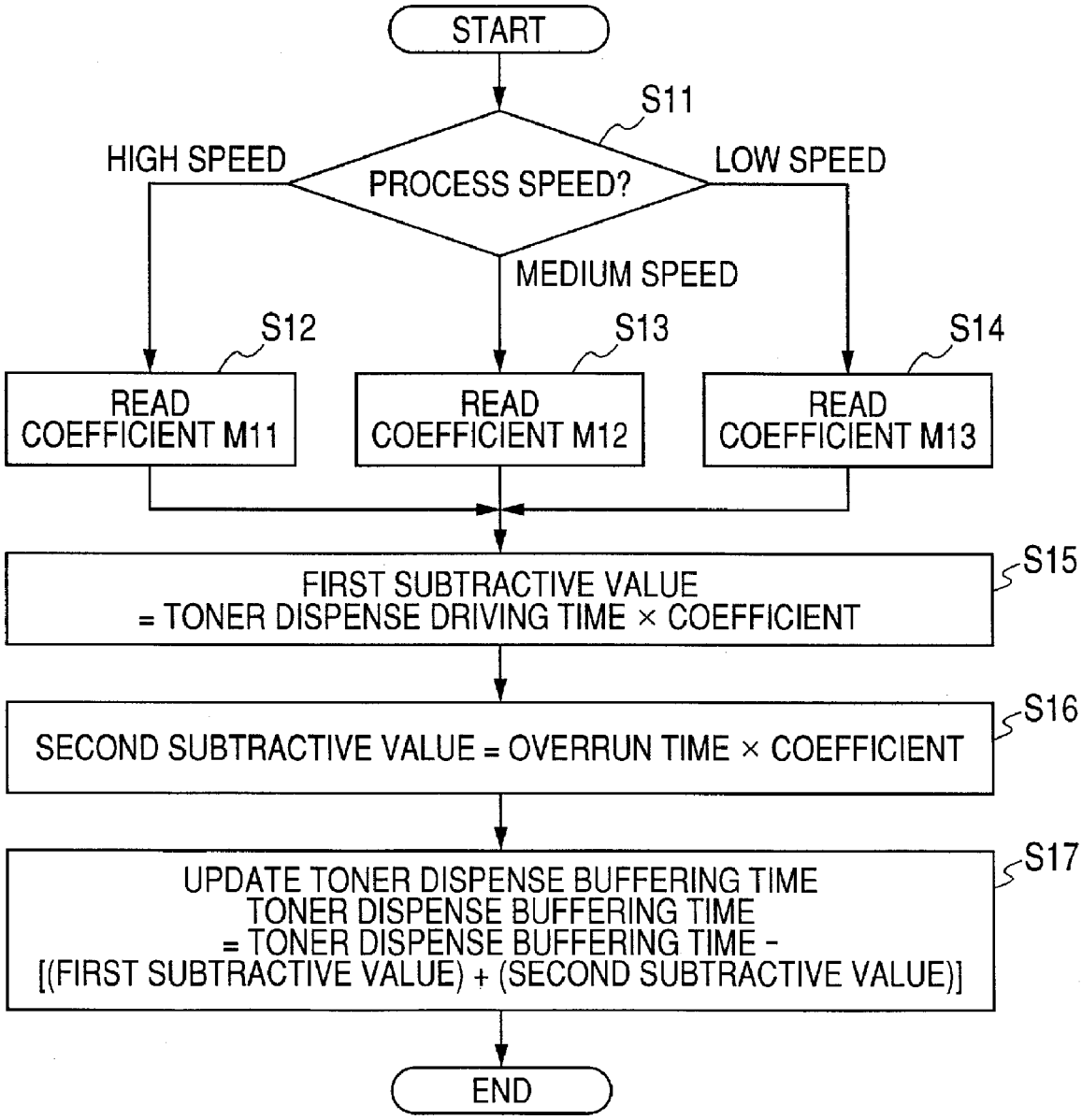
FIG. 5 is a flow chart showing the procedure of a toner dispense control process according to a second embodiment of the present invention.

FIG. 5 is a flow chart showing the procedure of a toner dispense control process according to a second embodiment of the present invention. This process flow is applied for the case of performing the above-described toner dispense buffering process. First, the toner dispense control section 21 determines whether the process speed notified from an image forming control section (not shown) is set to "high speed," "medium speed," or "low speed" (Step S11).

When it is determined in step S11 that the process speed is set to "high speed," a coefficient M11 stored in the memory 24 to correspond to the process speed of "high speed" is read (Step S12). When it is determined that the process speed is set to "medium speed," a coefficient M12 stored in the memory 24 to correspond to the process speed of "medium speed" is read (Step S13). When it is determined that the process speed is set to "low speed," a coefficient M13 stored in the memory 24 to correspond to the process speed of "low speed" is read (Step S14). These three coefficients M11, M12, and M13 are set to satisfy a magnitude relationship: "M11>M12>M13."

Next, the toner dispense control section 21 multiplies the driving time of the third auger 103, which corresponds to a first subtractive value from the toner dispense buffering time in the toner dispense buffering process, with the coefficient M11, M12, or M13 read in Step S12, S13, or S14, thereby correcting the first subtractive value (Step S15). Specifically, when the process speed is set to "high speed," the first subtractive value (toner dispense driving time) is multiplied with the coefficient M11. When the process speed is set to "medium speed," the first subtractive value is multiplied with the coefficient M12. When the process speed is set to "low speed," the first subtractive value is multiplied with the coefficient M13.

Next, the toner dispense control section 21 multiplies an overrun time of the third auger 103, which corresponds to a second subtractive value from the toner dispense buffering time in the toner dispense buffering process, with the coefficient M11, M12, or M13 read in Step S12, S13, or S14, thereby correcting the second subtractive value (Step S16). Specifically, when the process speed is set to "high speed," the second subtractive value (overrun time) is multiplied with the coefficient M11. When the process speed is set to "medium speed," the second subtractive value is multiplied with the coefficient M12. When the process speed is set to "low speed," the second subtractive value is multiplied with the coefficient M13.

The overrun time of the third auger 103 refers to a period from a time point at which the clutch control section 23 switches the clutch from on to off to a time point at which the rotation of the third auger 103 completely stops, that is, a period during which the third auger 103 still rotates after the end of the toner dispense driving time by the rotational inertial force. This overrun time can be predetermined through experiments. In the toner dispense buffering process, although the overrun time is not necessarily included in the subtractive value from the toner dispense buffering time, the overrun time if included may increase the precision.

Next, the toner dispense control section 21 update the toner dispense buffering time (Step S17) by applying the first subtractive value corrected in Step S15 and the second subtractive value corrected in Step S16. Specifically, the first subtractive value corrected in Step S15 and the second subtractive value corrected in Step S16 are added, and the additional value is subtracted from the toner dispense buffering time stored in the memory 24 at that moment, thereby updating the toner dispense buffering time applied to the toner dispensing operation in the subsequent developing period. The updated toner dispense buffering time is maintained in the memory 24.

In the process flow, when the process speed of the image forming operation is set to "high speed," the first subtractive value and the second subtractive value are corrected using the largest coefficient M11. When the process speed is set to "low speed," the first subtractive value and the second subtractive value are corrected using the smallest coefficient M13.

For this reason, assuming the coefficients are set such that: M11=1.2, M12=1.0, M13=0.8, the subtractive values are corrected in the direction that they increase when the process speed is set to "high speed," while the subtractive values are corrected in the direction that they decrease when the process speed is set to "low speed." As a result, in the actual toner dispensing operation, when the process speed is set to "high speed," the toner dispense driving time is changed so as to be shorter than that of the case of "medium speed," while when the process speed is set to "low speed," the toner dispense driving time is changed so as to be longer than that of the case of "medium speed."

As a specific example, a case will be considered in which image data, of which the ICDC toner dispense time calculated based on the number of pixels for one page is 1000 msec in common, are continuously processed into the same development color for 10 pages by rotating the rotary developing device 5. In this case, it is assumed that a coefficient applied for the process speed of "high speed" is set M11=1.2; a coefficient applied for the process speed of "medium speed" is set M12=1.0, and a coefficient applied for the process speed of "low speed" is set M13=0.8.

In such a case, when the process speed is set to "medium speed," since the ICDC toner dispense time is used, as it is, as the toner dispense driving time in the toner dispense buffering process, the sum of the toner dispense driving time required to process the image data for 10 pages becomes 10000 msec.

In contrast, when the process speed is set to "high speed" or "slow speed," the toner dispense buffering process is performed following the flow of numeric processing, as shown in FIG. 6. For example, when the process speed is set to "high speed," regarding the image data of the first page, since the toner dispense buffering time becomes 1000 msec by the addition of the ICDC toner dispense time, the toner dispensing operation is performed twice with a duration of 500 msec. For this reason, the toner dispense driving time becomes 1000 msec, a subtractive value (buffering subtractive value) from the toner dispense buffering time becomes 1200 by the multiplication with a coefficient M11 (=1.2). Therefore, a carry-over time to the subsequent period becomes −200 msec.

Regarding the image data for the second page, of which the process speed is set to "high speed," since the ICDC toner dispense time for one page is added to the carry-over time from the previous period, the toner dispense buffering time becomes 800 msec, the toner dispensing operation is performed only once with a duration of 500 msec. For this reason, the toner dispense driving time becomes 500 msec, and the subtractive value from the toner dispense buffering time becomes 600 msec by the multiplication with a coefficient M11 (=1.2). Therefore, a carry-over time to the subsequent operation becomes +200 msec.

On the other hand, when the process speed is set to "low speed," regarding the image data of the first page, since the toner dispense buffering time becomes 1000 msec by the addition of the ICDC toner dispense time, the toner dispensing operation is performed twice with a duration of 500 msec. For this reason, the toner dispense driving time becomes 1000 msec, a subtractive value (buffering subtractive value) from the toner dispense buffering time becomes 800 by the multiplication with a coefficient M13 (=0.8). Therefore, a carry-over time to the subsequent period becomes +200 msec.

Regarding the image data for the second page, of which the process speed is set to "high speed," since the ICDC toner dispense time for one page is added to the carry-over time from the previous period, the toner dispense buffering time becomes 1200 msec, the toner dispensing operation is performed twice with a duration of 500 msec. For this reason, the toner dispense driving time becomes 1000 msec, and the subtractive value from the toner dispense buffering time becomes 800 msec by the multiplication with a coefficient M13 (=0.8). Therefore, a carry-over time to the subsequent operation becomes +400 msec.

As a result, the sum of the toner dispense driving time required to process 10 pages becomes 8500 msec (850 msec on average for one page) for the process speed of "high speed." The sum of the toner dispense driving time required to process 10 pages becomes 10000 msec (1000 msec on average for one page) for the process speed of "medium speed." The sum of the toner dispense driving time required to process 10 pages becomes 12000 msec (1200 msec on average for one page) for the process speed of "low speed."

For the sake of explanation, it is assumed that the toner dispense rate is 1.2 mg/sec for the process speed of "high speed"; the toner dispense rate is 1.0 mg/sec for the process speed of "medium speed"; and the toner dispense rate is 0.8 mg/sec for the process speed of "low speed." In such a case, in the above example, the sum of the toner dispense amount for 10 pages becomes 10.2 mg (1.02 mg on average for one page) for the process speed of "high speed"; the sum of the toner dispense amount for 10 pages becomes 10 mg (1 mg on average for one page) for the process speed of "medium speed"; and the sum of the toner dispense amount for 10 pages becomes 9.6 mg (0.96 mg on average for one page) for the process speed of "low speed."

In contrast, for example, assuming that the coefficients M11, M12, and M13 are all set to 1.0, the sum of the toner dispense driving time required to process the image data for 10 pages becomes 10000 msec (1000 msec on average for one page) regardless of the process speed. For this reason, the sum of the toner dispense amount for 10 pages becomes 12 mg (1.2 mg on average for one page) for the process speed of "high speed"; the sum of the toner dispense amount for 10 pages becomes 10 mg (1 mg on average for one page) for the process speed of "medium speed"; and the sum of the toner dispense amount for 10 pages becomes 8.0 mg (0.8 mg on average for one page) for the process speed of "low speed."

Therefore, when image data for one page, of which the number of pixels is the same, are printed on a sheet with a differing process speed, even when the toner dispense rate varies with the differing process speed, the toner dispense amount for one page, dispensed to the developing chamber by the rotation of the third auger 103 is equalized regardless of the process speed.

Modified Example of First and Second Embodiments

As a modified example of the present invention, in the case in which the toner dispense control section 21 performs the toner dispense buffering process based on the process flow shown in FIG. 5, the upper limit of the toner dispense driving time that is permitted for one developing period may be changed in accordance with the process speed. The upper limit of the toner dispense driving time may be changed by changing at least one of the value of t and the value of n when the toner dispensing operation is performed a maximum of n times (n: an integer not less than 2) with a duration of t within the one developing period.

That is, by fixing the value of t and setting the value of n so as to be relatively great, the upper limit of the toner dispense driving time is changed in the direction that it increases, while by setting the value of n so as to be relatively small, the upper limit of the toner dispense driving time is changed in the direction that it decreases. By fixing the value of n and setting the value of t so as to be relatively great, the upper limit of the toner dispense driving time is changed in the direction that it increases, while by setting the value of t so as to be relatively small, the upper limit of the toner dispense driving time is changed in the direction that it decreases. By setting the values of t and n so as to be relatively great, the upper limit of the toner dispense driving time is changed in the direction that it increases, while by setting the values of t and n so as to be relatively small, the upper limit of the toner dispense driving time is changed in the direction that it decreases.

Figure 7:
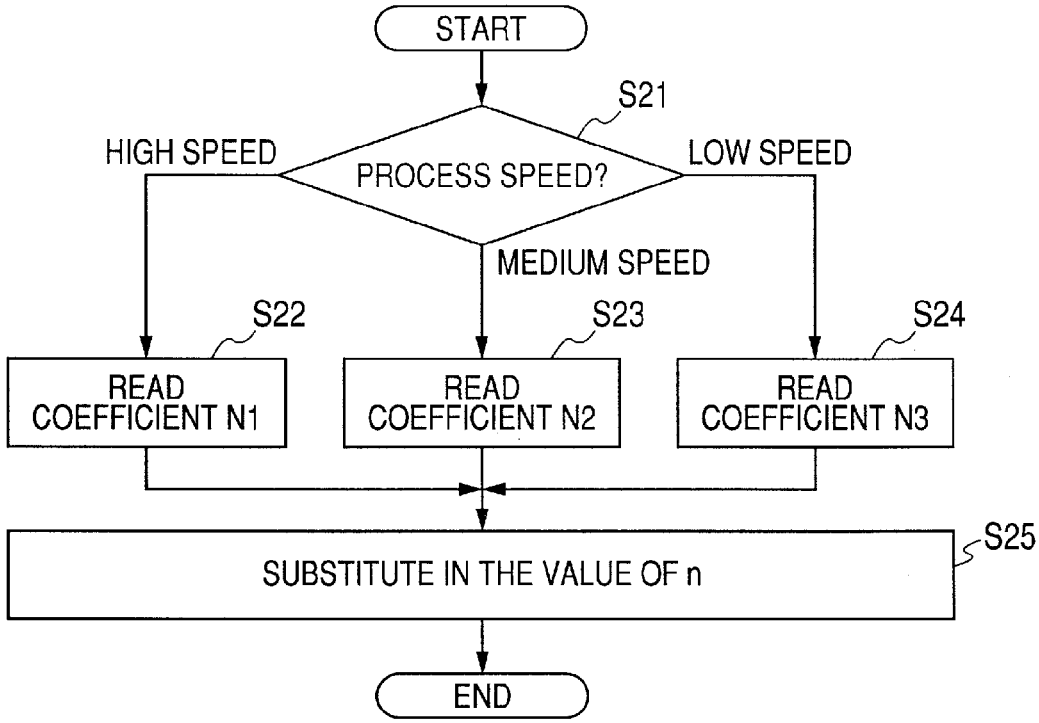
FIG. 7 is a flow chart showing the process according to a modified example of the first and second embodiments of the present invention.

FIG. 7 is a flow chart showing the procedure of the toner dispense control process applied for the case of changing the upper limit of the toner dispense driving time in accordance with the process speed. First, the toner dispense control section 21 determines whether the process speed notified from an image forming control section (not shown) is set to "high speed," "medium speed," or "low speed" (Step S21).

When it is determined in step S21 that the process speed is set to "high speed," a value N1 of a toner dispensing operation inhibiting number stored in the memory 24 to correspond to the process speed of "high speed" is read (Step S22). When it is determined that the process speed is set to "medium speed," a value N2 of the toner dispensing operation inhibiting number stored in the memory 24 to correspond to the process speed of "medium speed" is read (Step S23). When it is determined that the process speed is set to "low speed," a value N3 of the toner dispensing operation inhibiting number stored in the memory 24 to correspond to the process speed of "low speed" is read (Step S24). These three coefficients N1, N2, and N3 are all natural numbers and set to satisfy a magnitude relationship: "N1<N2<N3."

Next, the toner dispense control section 21 substitutes the value of n in the value of N1, N2, or N3 read in Step S22, S23, or S24 (Step 25). With this process flow, the value of n is changed in accordance with the process speed.

In the process flow shown in FIG. 7, since the three values N1, N2, and N3 are set to satisfy the magnitude relationship: "N1<N2<N3," when the process speed is set to "high speed," the toner dispensing operation inhibiting number is smaller than that of the case of "medium speed," while when the process speed is set to "low speed," the toner dispensing operation inhibiting number is greater than that of the case of "medium speed." Therefore, when the process speed is set to "high speed," the upper limit of the toner dispense driving time is changed so as to be smaller than that of the case of "medium speed," while when the process speed is set to "low speed," the upper limit of the toner dispense driving time is changed so as to be greater than that of the case of "medium speed."

Figure 8:
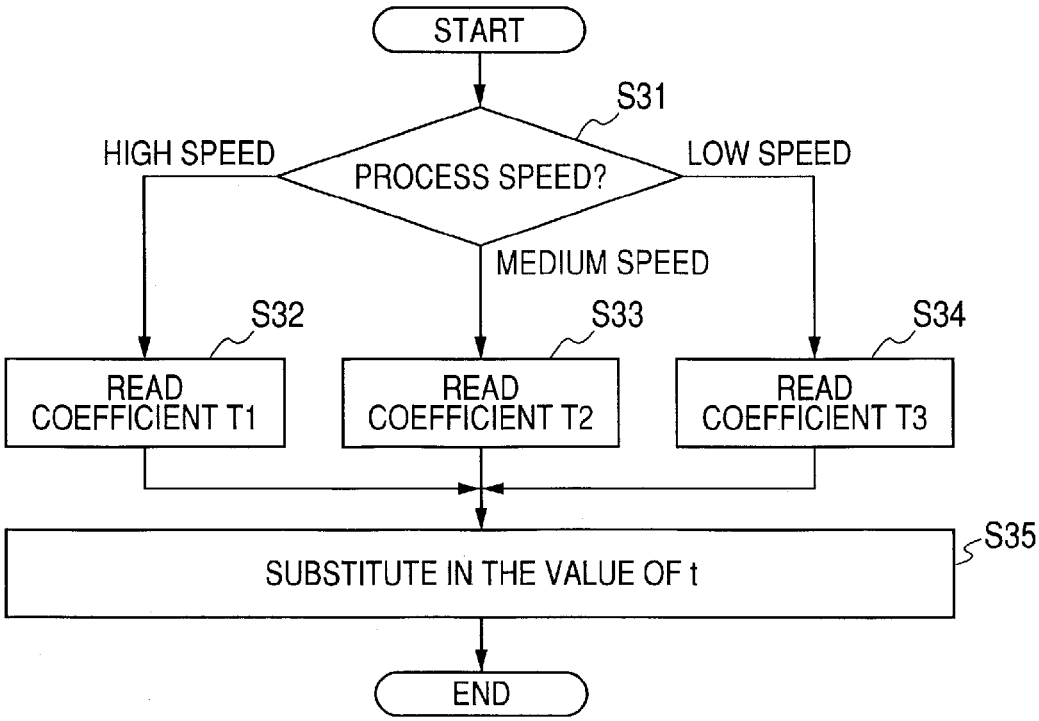
FIG. 8 is a flow chart showing the process according to a modified example of the first and second embodiments of the present invention.

In the process flow shown in FIG. 7, although the value of n is changed in accordance with the process speed, the value of t may be changed instead of changing the value of n. The process flow for such a case corresponds to the procedure of steps S31 to S35 shown in FIG. 8. In this case, even when any one of the values of n and t is changed, as the process speed increases, the upper limit of the toner dispense driving time is changed in the direction that it decreases. For this reason, in the process flow of FIG. 8, the values T1, T2, and T3 of a unit toner dispense driving time read from the memory 24 in Step S32, S33, or S34 are set to satisfy the magnitude relationship: "T1<T2<T3".

Third Embodiment

Figure 9:
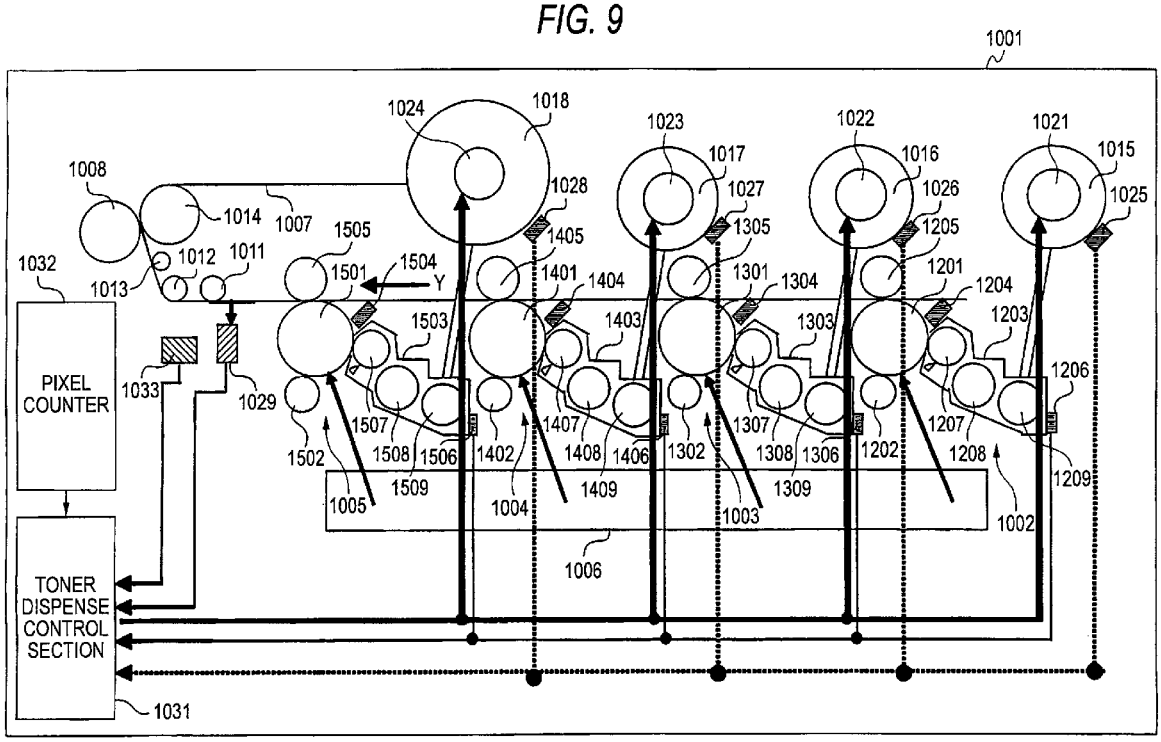
FIG. 9 is a schematic view showing an example of an overall construction of an image forming apparatus according to a third embodiment of the present invention.

FIG. 9 is a schematic view showing an example of an overall construction of an image forming apparatus according to an embodiment of the present invention. The image forming apparatus 1001 employs a four-wheeled, tandem machine construction, and includes four image forming sections 1002, 1003, 1004, and 1005, an exposure device 1006 common to the four image forming sections 1002, 1003, 1004, and 1005, an intermediate transfer member 1007, and a secondary transfer device 1008.

The image forming apparatus 1001 forms a full-color image using toner of four colors: yellow, magenta, cyan, and black in a polychromatic image forming mode, while forming a black/white image using a black toner in a monochromatic image forming mode. The image forming section 1002 forms a visible image using a yellow toner, and the image forming section 1003 forms a visible image using a magenta toner. In addition, the image forming section 1004 forms a visible image using a cyan toner, and the image forming section 1005 forms a visible image using a black toner. In the following descriptions, the visible image formed by the image forming sections 1002, 1003, 1004, and 1005 using the respective toner will be referred to a "toner image."

The image forming sections 1002, 1003, 1004, and 1005 are arranged in this order in the movement direction of the intermediate transfer member 1007 from the upstream side to the downstream side. That is, in the movement direction (the Y direction of the drawing) of the intermediate transfer member 1007, the image forming section 1003 is disposed on the downstream side of the image forming section 1002; the image forming section 1004 is disposed on the downstream side of the image forming section 1003; and the image forming section 1005 is disposed on the downstream side of the image forming section 1004.

The exposure device 6 irradiates laser light toward the corresponding image forming sections 1002, 1003, 1004, 1005 based on image data that are dissolved into respective color components of yellow, magenta, cyan, and black, and scans the laser light in a predetermined direction (main scanning direction).

The intermediate transfer member 1007 is constructed by an endless development belt. The intermediate transfer member 1007 is supported by a plurality of belt support rolls 1011, 1012, 1013, and 1014 in a loop shape (some portions are not shown in the drawing). These plural belt support rolls 1011 to 1014 cause the intermediate transfer member 1007 to move (travel) in the Y direction, which is a process direction of the image forming operation, at a predetermined speed while the intermediate transfer member 1007 being supported with a predetermined tension.

The secondary transfer device 1008 transfers the toner image transferred onto the intermediate transfer member 1007 onto a sheet (not shown). The secondary transfer device 1008 is disposed in an approaching or opposing relationship to the support roll 1014 in a form that the intermediate transfer member 1007 is sandwiched between the secondary transfer device 1008 and the support roll 1014. The sheet serving as the recording medium is conveyed to pass between the secondary transfer device 1008 and the support roll 1014, and a toner image is transferred onto the sheet from the intermediate transfer member 1007 during the conveyance. The sheet having the toner image transferred thereto is set to a fixing device (not shown), in which heat and pressure is applied thereto, thereby fixing the toner image onto the sheet.

The image forming sections 1002, 1003, 1004, and 1005 have mutually the same construction. Therefore, the construction of the image forming section 1002 will be described as a representative example. The image forming section 1002 is provided with an image carrying member 1201. During an image forming operation, the image carrying member 1201 rotates in the counterclockwise direction at a constant speed. In the vicinity of the image carrying member 1201, a charging unit 1202, a developing unit 1203, an image density sensor 1204, a primary transfer roll 1205, and the like are arranged in this order in the rotation direction of the image carrying member 1201.

The charging unit 1202 charges the surface of the image carrying member 1201 to a predetermined potential level. The developing unit 1203 develops an electrostatic latent image formed on the surface of the image carrying member 1201 by the exposure device 1006 using toner, thereby forming a toner image on the image carrying member 1201. A toner density sensor 1206 is attached to the developing unit 1203. The toner density sensor 1206 detects a toner density (TC: toner concentration) in a developing chamber. The image density sensor 1204 detects the density of the toner image formed on the image carrying member 1201. The primary transfer roll 1205 transfers the toner image formed on the surface of the image carrying member 1201 onto the intermediate transfer member 1007.

In the developing chamber of the developing unit 1203, a developing roll 1207, a supply auger 1208 and an agitating auger 1209 are mounted. When a developing motor (not shown) is provided as a developing unit driving source, the developing roll 1207, the supply auger 1208, and the agitating auger 1209 are rotated by using the developing motor as a common driving source. The developing unit 1203 and the developing unit driving source are provided as the developing means. Therefore, an operation speed of the developing means refers to rotation speeds of the developing roll 1207, the supply auger 1208, and the agitating auger 1209 or the driving speed (rotation speed) of the developing motor that determines the rotation speeds.

The developing roll 1207 magnetically absorbs and carries a bi-component developer composed of toner and carrier and conveys the developer in the circumferential direction by rotation of its own roll. The developing roll 1207 is constructed for example by a magnet roll and is disposed close to an opposing position (hereinafter, referred to as "development position") to the image carrying member 1201.

The supply auger 1208 supplies the bi-component developer to the developing roll 1207 while conveying the bi-component developer in the axial direction. The agitating auger 1209 charges toner to a predetermined polarity by friction with carrier while agitating and conveying the toner and the carrier. The supply auger 1208 and the agitating auger 1209 are disposed in a developing chamber that is partitioned by a partition wall (not shown). The developing roll 1207 is disposed to face the developing chamber in which the supply auger 1208 is disposed.

Like the image forming section 1002 having the aforedescribed construction, the image forming section 1003 is constructed to include an image carrying member 1301, a charging unit 1302, a developing unit 1303, an image density sensor 1304, a primary transfer roll 1305, a toner density sensor 1306, a developing roll 1307, a supply auger 1308, and an agitating auger 1309. Similarly, the image forming section 1004 is constructed to include an image carrying member 1401, a charging unit 1402, a developing unit 1403, an image density sensor 1404, a primary transfer roll 1405, a toner density sensor 1406, a developing roll 1407, a supply auger 1408, and an agitating auger 1409. Moreover, the image forming section 1005 is constructed to include an image carrying member 1501, a charging unit 502, a developing unit 1503, an image density sensor 1504, a primary transfer roll 1505, a toner density sensor 1506, a developing roll 1507, a supply auger 1508, and an agitating auger 1509.

Among the four image forming sections 1002, 1003, 1004, and 1005, to the developing unit 1203 of the image forming section 1002, a yellow toner is dispensed from a corresponding toner cartridge 1015 mounted in the device. A magenta toner is dispensed to the developing unit 1303 of the image forming section 1003 from a corresponding toner cartridge 1016 mounted in the device. A cyan toner is dispensed to the developing unit 1403 of the image forming section 1004 from a corresponding toner cartridge 1017 mounted in the device. A black toner is dispensed to the developing unit 1503 of the image forming section 1005 from a corresponding toner cartridge 1018 mounted in the device. Among these toner cartridges, the size of the toner cartridge 1018 is larger than that of the other toner cartridges 1015, 1016, and 1017.

The yellow toner stored in the toner cartridge 1015 is dispensed to the developing unit 1203 by the driving of a toner dispensing motor 1021, and the magenta toner stored in the toner cartridge 1016 is dispensed to the developing unit 1303 by the driving of a toner dispensing motor 1022. In addition, the cyan toner stored in the toner cartridge 1017 is dispensed to the developing unit 1403 by the driving of a toner dispensing motor 1023, and the black toner stored in the toner cartridge 1018 is dispensed to the developing unit 1503 by the driving of a toner dispensing motor 1024.

The toner dispensing motor 1021 is provided as a toner dispense driving source for a yellow toner. The toner dispensing motor 1021 serves as a driving source for rotating a toner dispense member (not shown) for yellow toner dispense. The toner dispensing motor 1022 is provided as a toner dispense driving source for a magenta toner. The toner dispensing motor 1022 serves as a driving source for rotating a toner dispense member (not shown) for magenta toner dispense. The toner dispensing motor 1023 is provided as a toner dispense driving source for a cyan toner. The toner dispensing motor 1023 serves as a driving source for rotating a toner dispense member (not shown) for magenta toner dispense. The toner dispensing motor 1024 is provided as a toner dispense driving source for a black toner. The toner dispensing motor 1024 serves as a driving source for rotating a toner dispense member (not shown) for black toner dispense.

The toner dispense member for yellow toner dispense and the toner dispensing motor 1021 are provided as the toner dispensing means for dispensing a yellow toner to the developing unit 1203. The toner dispense member for magenta toner dispense and the toner dispensing motor 1022 are provided as the toner dispensing means for dispensing a magenta toner to the developing unit 1303. The toner dispense member for cyan toner dispense and the toner dispensing motor 1023 are provided as the toner dispensing means for dispensing a cyan toner to the developing unit 1403. The toner dispense member for black toner dispense and the toner dispensing motor 1024 are provided as the toner dispensing means for dispensing a black toner to the developing unit 1503. Therefore, in the present embodiment, the operation speed of the toner dispensing means refers to rotation speeds of the toner dispense members corresponding to each color, or driving speeds (rotation speed) of the toner dispensing motors 1021, 1022, 1023, and 1024 that determine the rotation speeds.

A toner amount detecting sensor 1025 detects the amount (remaining amount) of toner stored in the toner cartridge 1015. A toner amount detecting sensor 1026 detects the amount of toner stored in the toner cartridge 1016. A toner amount detecting sensor 1027 detects the amount of toner stored in the toner cartridge 1017. A toner amount detecting sensor 1028 detects the amount of toner stored in the toner cartridge 1018.

In the vicinity of the support roll 1011, an ADC sensor 1029 is disposed to face the intermediate transfer member 1007 at an opposite side of the support roll 1011. The ADC sensor 1029 is provided to control the toner density using an ADC (Auto Density Control) type. The image density sensor 1029 detects a density of the toner image transferred onto the intermediate transfer member 1007 by the primary transfer rolls 1205, 1305, 1405, and 1505 that are arranged at predetermined intervals in the Y direction, particularly, a density of a toner patch formed for the purpose of density control.

The toner dispense control section 1031 calculates a toner dispense time based on various information (hereinafter, referred to as "toner density control information") received in order to stably control a toner density in the developing chamber, for each of the developing units 1203, 1303, 1403, and 1503 of each color, and controls the driving of the corresponding toner dispensing motors 1021, 1022, 1023, and 1024.

The toner dispense control section 1031 receives, as an example of the toner density control information, information from the toner density sensors 1206, 1306, 1406, and 1506, information from the toner amount detecting sensors 1025, 1026, 1027, and 1028, information from the ADC sensor 1029, information from the pixel counter 1032, and information from the temperature sensor 1033. The pixel counter 1032 counts the number of pixels (effective pixel number) for one page (one sheet face) of image data. For this reason, the information from the pixel counter 1032 represents a pixel coefficient value for one page. The temperature sensor 1033 detects a temperature (internal temperature) inside the device.

As the toner density control information, an image density for one page (a value obtained by dividing the number of entire pixels in one page by the effective pixel number) or information obtained by the image density sensors 1204, 1304, 1404, and 1504 may be used.

In the embodiment of the present invention, an example will be described in which the toner dispense time is calculated with reference to, among the various toner density control information, the information (information representing the pixel coefficient value) from the pixel counter 1032 and the information (information representing the patch density) from the ADC sensor 1029.

Figure 10:
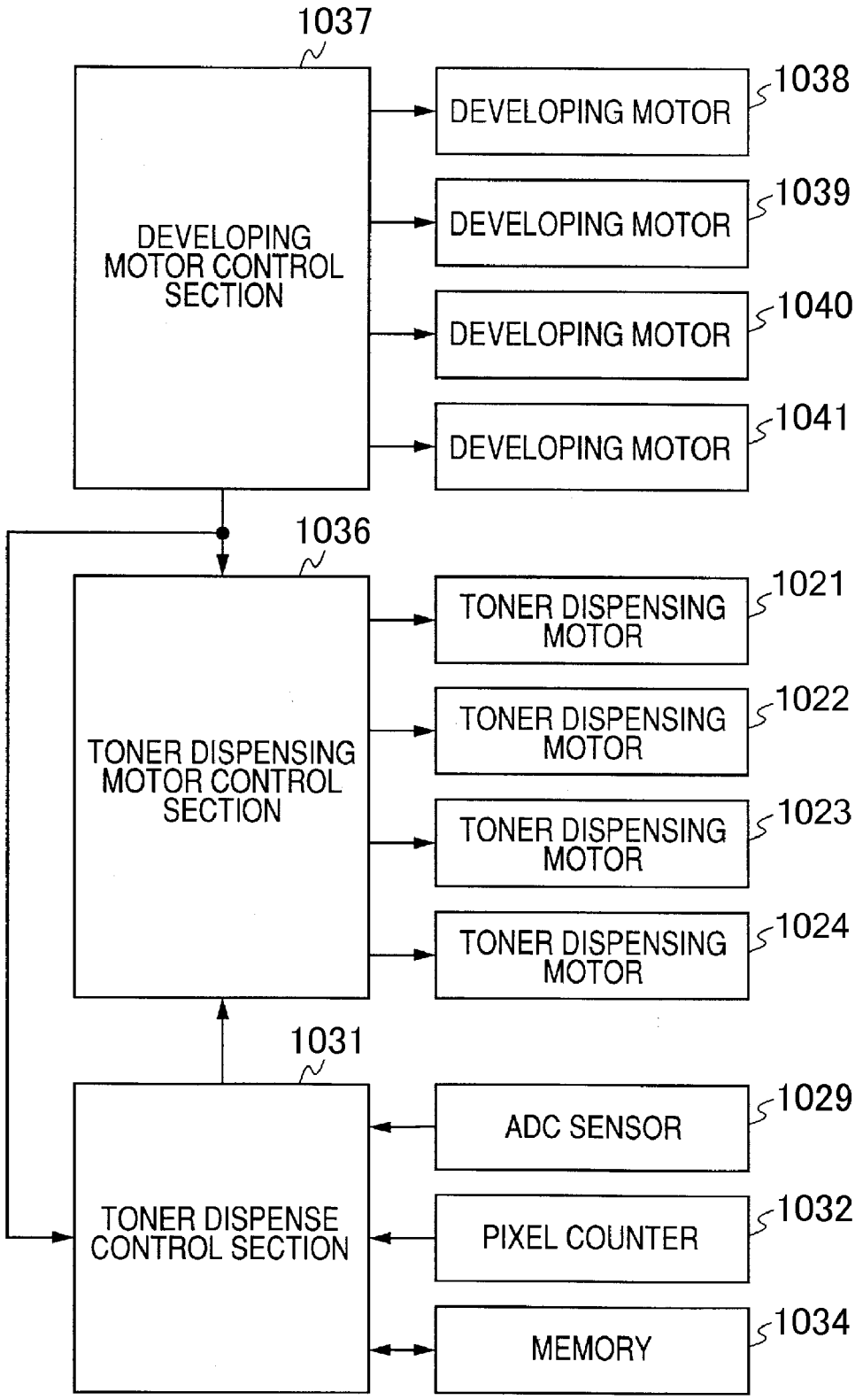
FIG. 10 is a block diagram showing a simplified construction of a control system of the image forming apparatus according to a third embodiment of the present invention.

FIG. 10 is a block diagram showing a simplified construction of a control system of the image forming apparatus according to an embodiment of the present invention. The toner dispense control section 1031 includes a memory 1034 connected thereto, in addition to the above-described ADC sensor 1029 and the pixel counter 1032. The memory 1034 is used to store various data or information related to the toner dispense control.

A toner dispensing motor control section 1036 controls the driving of the above-described toner dispensing motors 1021, 1022, 1023, and 1024 in a separate manner based on a motor drive command from the toner dispense control section 1031. A developing motor control section 1037 controls the driving of the developing motors 1038, 1039, 1040, and 1041 in a separate manner based on a motor drive command from an image forming control section (not shown). The developing motor 1038 serves as a driving source of the developing unit 1203, and the developing motor 1039 serves as a driving source of the developing unit 1303. In addition, the developing motor 1040 serves as a driving source of the developing unit 1403, and the developing motor 1041 serves as a driving source of the developing unit 1503.

Figure 11:
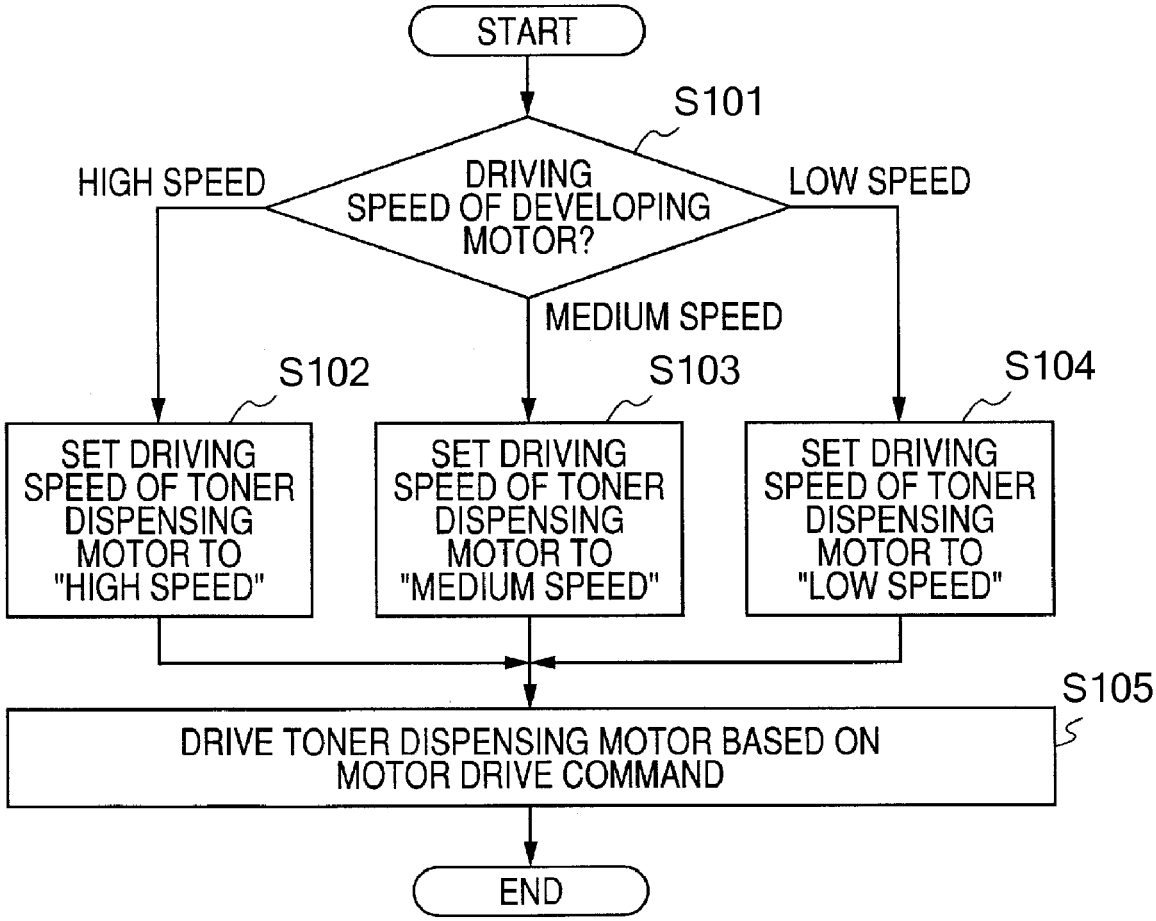
FIG. 11 is a flow chart showing the procedure of a speed setting process of a toner dispensing motor.

FIG. 11 is a flow chart showing the procedure of a speed setting process of a toner dispensing motor, performed by the toner dispensing motor control section 1036. First, the toner dispensing motor control section 1036 determines whether the driving speed of the developing motor is set to "high speed," "medium speed," or "low speed" (Step S101). In the present embodiment, an example will be described in which the process speed of an image forming operation, the driving speed of the developing motor, and the driving speed of the toner dispensing motor are switched in three steps: "high speed," "medium speed," and "low speed." Among these speed steps, the "medium speed" corresponds to a normal (standard) speed, and the "high speed" is higher than the "medium speed," and the "low speed" is lower than "medium speed." The driving speed of the developing motor is defined by the number of rotations in a unit time of a motor (i.e., the rpm of the motor). The driving speed of the developing motor depends on the process speed of an image forming operation. The process speed of the image forming operation is determined by the peripheral speed of the image carrying member (1201, 1301, 1401, and 1501) at the development position or the movement speed of the intermediate transfer member 1007. The peripheral speed of the developing roll is set to maintain a constant ratio to the peripheral speed of the image carrying member. For this reason, the peripheral speed of the developing roll is proportional to the process speed. The driving speed of the developing motor or the peripheral speed of the developing roll determined by the driving speed corresponds to "the operation speed of the developing means."

Therefore, in a case where plural process speeds are present due to difference in the image quality required (set) for an image forming operation, for example, the peripheral speed of the developing roll varies in proportion to the process speed applied to the image forming operation. In the present embodiment, an example will be described in which the process speed of an image forming operation (i.e., the peripheral speed of the image carrying member) is switched by the image forming control section (not shown) in three steps, as described above, in accordance with an image forming condition such as an image quality setting.

In such a case, when the process speed is set to "high speed" by the image forming control section, the driving speed of the developing motor is accordingly set to "high speed" by the developing motor control section 1037. When the process speed is set to "medium speed," the driving speed of the developing motor is accordingly set to "medium speed." When the process speed is set to "low speed," the driving speed of the developing motor is accordingly set to "low speed." Since the process speed of the image forming operation is set to maintain a constant ratio to the driving speed of the developing motor, even when both speeds are set to "high speed," the speeds are not necessarily the same.

When it is determined in Step S101 that the driving speed of the developing motor is set to "high speed," the toner dispensing motor control section 1036 sets the driving speed of the toner dispensing motor to "high speed" accordingly (Step S102). When it is determined that the driving speed of the developing motor is set to "medium speed," the toner dispensing motor control section 1036 sets the driving speed of the toner dispensing motor to "medium speed" accordingly (Step S103). When it is determined that the driving speed of the developing motor is set to "low speed," the toner dispensing motor control section 1036 sets the driving speed of the toner dispensing motor to "low speed" accordingly (Step S104).

Next, the toner dispensing motor control section 1036 rotates the toner dispensing motors 1021, 1022, 1023, and 1024 at the driving speed set in Step S102, S103, or S104 based on the motor drive command sent from the toner dispense control section 1031 (Step S105). That is, when the driving speed of the toner dispensing motor is set to "high speed" in Step S102, the toner dispensing motor control section 1036 rotates the toner dispensing motor at "high speed" in accordance with the speed setting. When the driving speed of the toner dispensing motor is set to "medium speed" in Step S103, the toner dispensing motor control section 1036 rotates the toner dispensing motor at "medium speed" in accordance with the speed setting. When the driving speed of the toner dispensing motor is set to "low speed" in Step S104, the toner dispensing motor control section 1036 rotates the toner dispensing motor at "low speed" in accordance with the speed setting.

In the process flow, when the driving speed of the developing motor is set to "high speed," the driving speed of the toner dispensing motor is accordingly set to "high speed"; when the driving speed of the developing motor is set to "medium speed," the driving speed of the toner dispensing motor is accordingly set to "medium speed"; and when the driving speed of the developing motor is set to "low speed," the driving speed of the toner dispensing motor is accordingly set to "low speed."

In this way, for example, in the developing unit 1203, when the rotation speed of the developing motor 1038 that determines the rotation speed of the agitating auger 1209 is relatively high, the rotation speed of the toner dispensing motor 1021 that determines the rotation speed of the toner dispense member is corrected so as to be relatively high. When the rotation speed of the developing motor 1038 is relatively low, the rotation speed of the toner dispensing motor 1021 is corrected so as to be relatively low. For this reason, even when the process speed of the image forming operation varies, the balance between the conveyance speed of developer and the conveyance speed of toner dispense is maintained. The same statements can be applied to the other developing units 1303, 1403, and 1503. However, in maintaining the balance between the conveyance speed of developer and the conveyance speed of toner dispense, the relationship (speed ratio) between these speeds is not necessarily be constant.

As a specific example of a case in which the balance between the developer conveyance speed and the toner dispense conveyance speed is destroyed, for example, a case can be considered in which the toner dispense conveyance speed is much higher than the developer conveyance speed. In such a case, although there is a fear that toner clogging is caused in the developing unit 1203, it is possible to obviate such fear by maintaining the balance between them.

The toner dispense control section 1031 predicts an amount of toner consumption for one page by computation based on the information on the pixel coefficient value received from the pixel counter 1032 and calculates a toner dispense time required to dispense toner by the amount corresponding to the amount of toner consumption. The toner dispense control section 1031 controls the toner dispense to the developing unit (developing chamber) by rotating the toner dispensing motor with reference to the toner dispense time (i.e., by using the time as a control parameter) within a toner dispensing period corresponding to a period (hereinafter, referred to as "developing period") in which an arbitrary one of the developing units performs an developing operation. One developing period is defined as a period in which the electrostatic latent image formed on the image carrying member passes the opposing position to the developing roll, and one toner dispensing period is defined to correspond to the one developing period. Within one toner dispensing period, the toner dispense amount varies with the length of time in which the toner dispensing motor (1021 to 1024) is actually driven. The above-described type of toner dispense control base on the pixel coefficient value is also referred to as an ICDC (Image Count Dispense Control) type.

The toner dispense control section 1031 uses an ADC (Auto Density Control) type toner density control using the ADC sensor 1029 in combination with the ICDC type toner density control using the pixel counter 1032. In the case of using the ADC type toner density control in combination, whenever the toner image is developed for a predetermined number of pages, for example, the density of the toner patch is detected by the ADC sensor 1029 and the toner dispense time is calculated base on the detection result. When the density of the toner patch detected by the ADC sensor 1029 is higher than a target reference density, the toner dispense driving time calculated by the ADC type becomes a negative value corresponding to the density difference. When the toner patch density is lower than the reference density, the toner dispense driving time becomes a positive value corresponding to the density difference.

The toner dispense control section 1031 calculates the toner dispense time by the following expression (1), in which a toner dispense time calculated by the ICDC type is defined as "ICDC toner dispense time" and a toner dispense time calculated by the ADC type is defined as "ADC toner dispense time."

$$\text{Toner Dispense Time} = \text{ICDC Toner Dispense Time} + \text{ADC Toner Dispense Time} \quad (1)$$

The amount of toner for a unit time, dispensed to the developing unit (developing chamber) by the rotation of the toner dispensing motor, i.e., a toner dispense rate depends on the rotation speed of the toner dispensing motor. Specifically, as the rotation speed of the toner dispensing motor increases, the toner dispense rate increases. Therefore, even when the toner dispensing motor is rotated for the same period of time, as the driving speed of the toner dispensing motor is changed in accordance with the driving speed of the developing motor, the toner dispense amount varies accordingly. The toner dispense amount refers to the amount of toner dispensed to the developing chamber of the developing unit by the driving of the toner dispensing means (which corresponds to the toner dispensing motor or the like).

Here, when a time in which the toner dispensing means is actually driven is defined as a toner dispense driving time, and when the toner dispense driving time is expressed in units of milliseconds [msec]; the toner dispense amount is expressed in units of milligrams [mg]; and the toner dispense rate is expressed in units of milligram/second [mg/sec], the relationship of the following expression (2) is satisfied between them.

$$\text{Toner Dispense Amount} = \text{Toner Dispense Rate} \times 10^{-3} \times \text{Toner Dispense Driving Time} \quad (2)$$

In the expression (2), when the toner dispense driving time is constant, the toner dispense amount increases as the toner dispense rate increases; conversely, the toner dispense amount decreases as the toner dispense rate decreases. As a specific example, when the toner dispense driving time maintains a constant value (=1000 msec), the toner dispense amount becomes 200 mg for the toner dispense rate of 200 mg/sec, while the toner dispense amount becomes 300 mg for the toner dispense rate of 300 mg/sec. For this reason, a difference of 100 mg in the toner dispense amount is caused by the differing toner dispense rate.

In contrast, in the image forming apparatus 1001 of the present invention, the toner dispense control section 1031 performs a process (details of which will be described later) of changing the driving time (toner dispense driving time) of the toner dispensing motor in accordance with the driving speed of the developing motor so that the toner dispense amount does not vary even when the driving speed of the toner dispensing motor is changed in accordance with the driving speed of the developing motor. In such a process, the driving time of the toner dispensing motor is changed so as to be relatively short when the driving speed of the developing motor is relatively high, while the driving time of the toner dispensing motor is changed so as to be relatively long when the driving speed of the developing motor is relatively low. With this, the difference in the toner dispense amount by the differing toner dispense rate decreases compared with the case in which the toner dispense driving time is constant, as described above.

As a specific example, when the toner dispense driving time is 1000 msec for the toner dispense rate of 200 mg/sec and when the toner dispense driving time is 700 msec for the toner dispense rate of 300 mg/sec, the toner dispense amount becomes 200 mg for the toner dispense rate of 200 mg/sec, while the toner dispense amount becomes 210 mg for the toner dispense rate of 300 mg/sec. For this reason, a difference of 10 mg in the toner dispense amount is caused even when the toner dispense rate differs, and the difference amount corresponds to 1/10 of the amount when the toner dispense driving time is constant.

Figure 12:
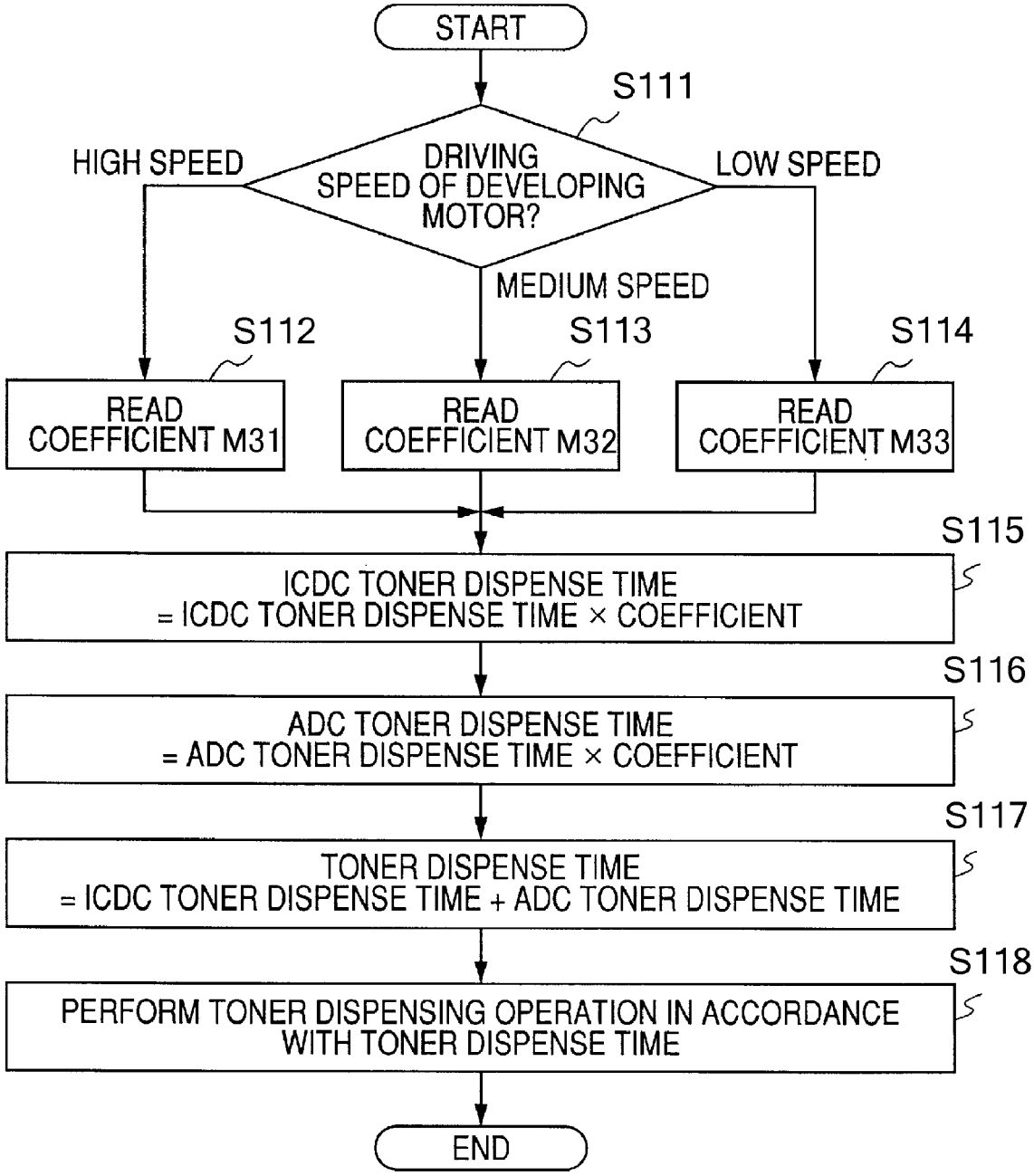
FIG. 12 is a flow chart showing an example of the procedure of a toner dispense control process according to a third embodiment of the present invention.

FIG. 12 is a flow chart showing an example of a toner dispense control process according to a third embodiment of the present invention. First, the toner dispense control section 1031 determines whether the driving speed of the developing motor notified from the developing motor control section 1037 (or an image forming control section) is set to "high speed," "medium speed," or "low speed" (Step S111).

When it is determined in step S111 that the driving speed of the developing motor is set to "high speed," a coefficient M31 stored in the memory 1034 to correspond to the speed setting of "high speed" is read (Step S112). When it is determined that the driving speed of the developing motor is set to "medium speed," a coefficient M32 stored in the memory 1034 to correspond to the speed setting of "medium speed" is read (Step S113). When it is determined that the driving speed of the developing motor is set to "low speed," a coefficient M33 stored in the memory 1034 to correspond to the speed setting of "low speed" is read (Step S114). These three coefficients M31, M32, and M33 are set to satisfy a magnitude relationship: "M31<M32<M33."

Next, the toner dispense control section 1031 multiplies the ICDC toner dispense time calculated by the ICDC type with the coefficient M31, M32, or M33 read in Step S112, S113, or S114, thereby correcting the ICDC toner dispense time (Step S115). Specifically, when the driving speed of the developing motor is set to "high speed," the ICDC toner dispense time is multiplied with the coefficient M31. When the driving speed of the developing motor is set to "medium speed," the ICDC toner dispense time is multiplied with the coefficient M32. When the driving speed of the developing motor is set to "low speed," the ICDC toner dispense time is multiplied with the coefficient M33.

Next, the toner dispense control section 1031 multiplies the ADC toner dispense time calculated by the ADC type with the coefficient M31, M32, or M33 read in Step S112, S113, or S114, thereby correcting the ADC toner dispense time (Step S116). Specifically, when the driving speed of the developing motor is set to "high speed," the ADC toner dispense time is multiplied with the coefficient M31. When the driving speed of the developing motor is set to "medium speed," the ADC toner dispense time is multiplied with the coefficient M32. When the driving speed of the developing motor is set to "low speed," the ADC toner dispense time is multiplied with the coefficient M33.

Next, the toner dispense control section 1031 calculates a toner dispense time applied to a toner dispensing operation based on the expression (1) (Step S117), by using the ICDC toner dispense time corrected in Step S15 and the ADC toner dispense time corrected in Step S116.

Next, the toner dispense control section 1031 sends a motor drive command to the toner dispensing motor control section 1036 based on the toner dispense time calculated in Step S117, thereby rotating the toner dispensing motor to execute the toner dispensing operation (Step S118). In this case, the toner dispensing motor control section 1036 rotates the respective toner dispensing motors for a period corresponding to the toner dispense time included in the motor drive command sent from the toner dispense control section 1031 to each developing unit (for each color) within the toner dispensing period corresponding to the respective developing periods of the developing units 1203, 1303, 1403, and 1503.

In the process flow, when the driving speed of the developing motor is set to "high speed," the toner dispense time (ICDC toner dispense time+ADC toner dispense time) is corrected using the smallest coefficient M31. When the driving speed of the developing motor is set to "low speed," the toner dispense time is corrected using the largest coefficient M33.

For this reason, assuming the coefficients are set such that: M31=0.8, M32=1.0, M33=1.2, the toner dispense time is corrected in the direction that it becomes short when the driving speed of the developing motor is set to "high speed," while the toner dispense time is corrected in the direction that it becomes long when the driving speed of the developing motor is set to "low speed." As a result, in the actual toner dispensing operation, when the driving speed of the developing motor is set to "high speed," the toner dispense driving time is changed so as to be shorter than that of the case of "medium speed," while when the driving speed of the developing motor is set to "low speed," the toner dispense driving time is changed so as to be longer than that of the case of "medium speed."

As a specific example, a case will be considered in which image data, of which the ICDC toner dispense time calculated based on the number of pixels for one page is 1000 msec in common, are continuously processed into the same development color for 10 pages. In this case, it is assumed that a coefficient applied for the driving speed of the developing motor set to "high speed" is set M31=0.8; a coefficient applied for the driving speed of the developing motor set to "medium speed" is set M32=1.0, and a coefficient applied for the driving speed of the developing motor set to "low speed" is set M33=1.2.

In such a case, when the driving speed of the developing motor is set to "medium speed," since the ICDC toner dispense time is used, as it is, as the toner dispense driving time, the sum of the toner dispense driving time required to process the image data for 10 pages becomes 10000 msec (1000 msec on average for one page). When the driving speed of the developing motor is set to "high speed," since the ICDC toner dispense time multiplied with the coefficient M31 (=0.8) is used as the toner dispense driving time, the sum of the toner dispense driving time required to process the image data for 10 pages becomes 8000 msec (800 msec on average for one page). When the driving speed of the developing motor is set to "low speed," since the ICDC toner dispense time multiplied with the coefficient M33 (=1.2) is used as the toner dispense driving time, the sum of the toner dispense driving time required to process the image data for 10 pages becomes 12000 msec (1200 msec on average for one page).

For the sake of explanation, it is assumed that the toner dispense rate is 1.2 mg/sec for the driving speed of the toner dispensing motor set to "high speed"; the toner dispense rate is 1.0 mg/sec for the driving speed of the developing motor set to "medium speed"; and the toner dispense rate is 0.8 mg/sec for the driving speed of the developing motor set to "low speed." In such a case, in view of the fact that in the process flow shown in FIG. 11, the driving speed of the toner dispensing motor is set to "high speed" when the driving speed of the developing motor is set to "high speed"; the driving speed of the toner dispensing motor is set to "medium speed" when the driving speed of the developing motor is set to "medium speed"; and the driving speed of the toner dispensing motor is set to "low speed" when the driving speed of the developing motor is set to "low speed," in the above example, the sum of the toner dispense amount for 10 pages becomes 9.6 mg (0.96 mg on average for one page) for the driving speed of the toner dispensing motor set to "high speed"; the sum of the toner dispense amount for 10 pages becomes 10 mg (1 mg on average for one page) for the driving speed of the toner dispensing motor set to "medium speed"; and the sum of the toner dispense amount for 10 pages becomes 9.6 mg (0.96 mg on average for one page) for the driving speed of the toner dispensing motor set to "low speed."

In contrast, for example, assuming that the coefficients M31, M32, and M33 are all set to 1.0, the sum of the toner dispense driving time required to process the image data for 10 pages becomes 10000 msec (1000 msec on average for one page) regardless of the driving speed of the developing motor. For this reason, the sum of the toner dispense amount for 10 pages becomes 12 mg (1.2 mg on average for one page) for the driving speed of the developing motor set to "high speed"; the sum of the toner dispense amount for 10 pages becomes 10 mg (1 mg on average for one page) for the driving speed of the developing motor set to "medium speed"; and the sum of the toner dispense amount for 10 pages becomes 8.0 mg (0.8 mg on average for one page) for the driving speed of the developing motor set to "low speed."

Therefore, when image data for one page, of which the number of pixels counted by the pixel counter 1032 is the same, are printed on a sheet under a different condition of the driving speed of the developing motor, even when the toner dispense rate varies with the differing driving speed of the toner dispensing motor, the toner dispense amount for one page is equalized regardless of the driving speed of the toner dispensing motor by changing the toner dispense driving time according to the process flow shown in FIG. 12.

However, there is a case in which the toner dispensing operation by the driving of the toner dispensing motor is performed, for toner of one color, a maximum of n times (n: a natural number not less than 2) with a duration of t within one toner dispensing period, considering the agitation or charging properties of toner. In such a case, assuming that the toner dispense driving time t for one toner dispensing operation is defined as a unit toner dispense driving time, an upper limit of the toner dispense driving time that is permitted for one toner dispensing period is defined as n×t.

Regarding toner of any one color, if the toner dispense time applied to the toner dispensing operation is greater than the upper limit (n×t), there may be a case that the toner dispensing operation is not completed within the one toner dispensing period. In such a case, regarding the toner of any one color, the toner dispense driving time corresponding to the amount of time that has not been processed in the previous toner dispensing period is added to a subsequent toner dispensing period of the toner dispensing operation, thereby supplementing the deficiency in the toner dispense. In the subsequent descriptions, such a process will be referred to as "toner dispense buffering process."

In the toner dispense buffering process, for each of the developing units 1203, 1303, 1403, and 1503 of each color, a toner dispense buffering time is stored in the memory 1034. That is, the toner dispense buffering time is maintained in the memory 1034 for each development color of yellow, magenta, cyan, and black. Regarding the developing unit of the corresponding development color, the toner dispense time calculated by the ICDC type or the ADC type is used as an additional value to the toner dispense buffering time, and the driving time (toner dispense driving time) of the toner dispensing motor is used as a subtractive value from the toner dispense buffering time. In this manner, the toner dispense buffering process is performed while updating the toner dispense buffering time in the memory 1034.

(Concept of Toner Dispense Buffering Process)

If the toner dispensing operation is performed a maximum of n times (n: a natural number not less than 2) with a duration of t within one toner dispensing period, the number of toner dispensing operations in each of the toner dispensing periods is determined based the toner dispense buffering time. Specifically, among the quotient (an integer) and the remainder obtained when the toner dispense buffering time is divided by the value of t, the number of toner dispensing operations is determined by the value of the quotient; the toner dispense driving time corresponding to the determined number is subtracted from the toner dispense buffering time, and the value of the remainder is used as a carry-over to the subsequent period. When the toner dispense buffering time is greater than t×n, the upper limit of the toner dispense driving time, the surplus is used as a carry-over to the subsequent period. When the toner dispense buffering time has a negative value, the toner dispense buffering time is used, as it is, as a carry-over to the subsequent period.

(Example of Toner Dispense Buffering Process)

In a system construction of a toner density control system capable of performing a toner dispensing operation a maximum of 3000 msec (n=6, and t=500 msec) within one toner dispensing period, assuming that the toner dispense buffering time stored in the memory 1034 before the present toner dispensing period starts is 1000 msec, the toner dispensing operation by the driving of the toner dispensing motor is performed twice with a duration of 500 msec in the present toner dispensing period. For this reason, the toner dispense buffering time stored in the memory 1034 becomes 0 msec since 1000 msec used as the driving time of the toner dispensing motor in the present toner dispensing period is subtracted therefrom.

In contrast, assuming that the toner dispense buffering time before the present toner dispensing period starts is 800 msec, the toner dispensing operation by the driving of the toner dispensing motor is performed only once with a duration of 500 msec in the present toner dispensing period. For this reason, the toner dispense buffering time stored in the memory 1034 becomes 300 msec since 500 msec used as the driving time of the toner dispensing motor in the present toner dispensing period is subtracted therefrom. The amount of time, 300 msec that has not been processed in the present toner dispensing period becomes a carry-over to the subsequent period. If the ICDC toner dispense time calculated before the subsequent toner dispensing period starts is 800 msec, this amount of time is added to the carry-over (300 msec) from the previous period and included in the subsequent toner dispensing period. For this reason, the toner dispense buffering time before the subsequent toner dispensing period starts becomes 1100 msec. Therefore, the toner dispensing operation by the driving of the toner dispensing motor is performed twice with a duration of 500 msec in the subsequent toner dispensing period.

In a state that the toner dispense buffering time stored in the memory 1034 is 300 msec, if the ADC toner dispense time calculated before the present toner dispensing period starts is −500 msec, the toner dispense buffering time in the memory 1034 becomes −200 msec by the addition of the two toner dispense buffering times. For this reason, the toner dispensing operation by the driving of the toner dispensing motor is not performed in the present toner dispensing period. In contrast, in a state that the toner dispense buffering time stored in the memory 1034 is 300 msec, if the ADC toner dispense time calculated before the present toner dispensing period starts is +200 msec, the toner dispense buffering time in the memory 1034 becomes 500 msec by the addition of the two toner dispense buffering times. For this reason, the toner dispensing operation by the driving of the toner dispensing motor is performed only once with a duration of 500 msec in the present toner dispensing period.

Figure 13:
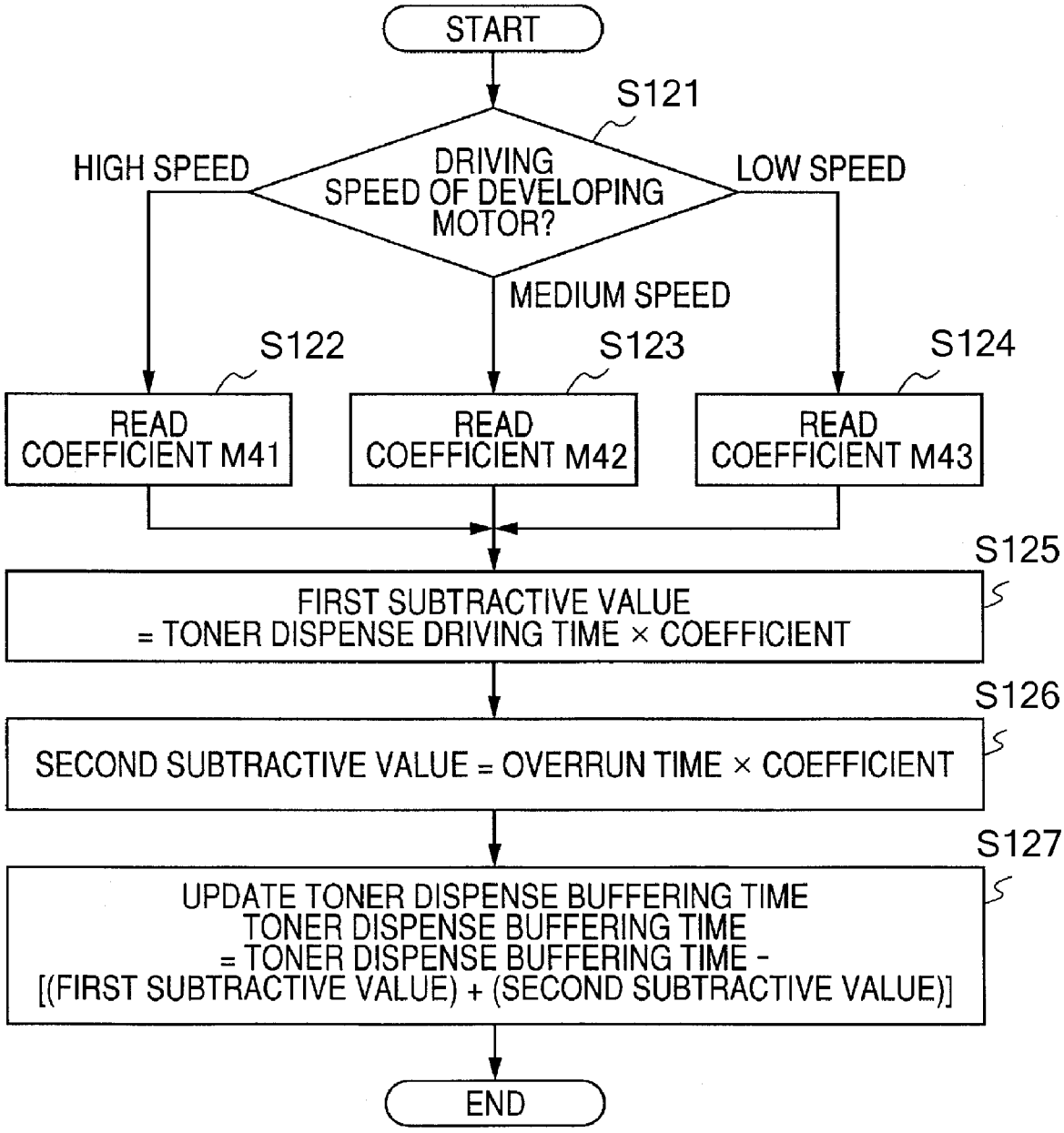
FIG. 13 is a flow chart showing another example of the procedure of the toner dispense control process according to a third embodiment of the present invention.

FIG. 13 is a flow chart showing another example of the procedure of the toner dispense control process according to the embodiment of the present invention. This process flow is applied for the case of performing the above-described toner dispense buffering process. First, the toner dispense control section 1031 determines whether the driving speed of the developing motor notified from the developing motor control section 1037 (or an image forming control section) is set to "high speed," "medium speed," or "low speed" (Step S121).

When it is determined in step S121 that the driving speed of the developing motor is set to "high speed," a coefficient M41 stored in the memory 1034 to correspond to the speed setting of "high speed" is read (Step S122). When it is determined that the driving speed of the developing motor is set to "medium speed," a coefficient M42 stored in the memory 1034 to correspond to the speed setting of "medium speed" is read (Step S123). When it is determined that the driving speed of the developing motor is set to "low speed," a coefficient M43 stored in the memory 1034 to correspond to the speed setting of "low speed" is read (Step S124). These three coefficients M41, M42, and M43 are set to satisfy a magnitude relationship: "M41>M42>M43."

Next, the toner dispense control section 1031 multiplies the driving time of the toner dispensing motor, which corresponds to a first subtractive value from the toner dispense buffering time in the toner dispense buffering process, with the coefficient M41, M42, or M43 read in Step S122, S123, or S124, thereby correcting the first subtractive value (Step S125). Specifically, when the driving speed of the developing motor is set to "high speed," the first subtractive value (toner dispense driving time) is multiplied with the coefficient M41. When the driving speed of the developing motor is set to "medium speed," the first subtractive value is multiplied with the coefficient M42. When the driving speed of the developing motor is set to "low speed," the first subtractive value is multiplied with the coefficient M43.

Next, the toner dispense control section 1031 multiplies an overrun time of the toner dispensing motor, which corresponds to a second subtractive value from the toner dispense buffering time in the toner dispense buffering process, with the coefficient M41, M42, or M43 read in Step S122, S123, or S124, thereby correcting the second subtractive value (Step S126). Specifically, when the driving speed of the developing motor is set to "high speed," the second subtractive value (overrun time) is multiplied with the coefficient M41. When the driving speed of the developing motor is set to "medium speed," the second subtractive value is multiplied with the coefficient M42. When the driving speed of the developing motor is set to "low speed," the second subtractive value is multiplied with the coefficient M43.

The overrun time of the toner dispensing motor refers to a period from a time point at which the toner dispensing motor control section 1036 stops outputting a driving signal to the toner dispensing motor (1021, 1022, 1023, 1024) to a time point at which the rotation of the toner dispensing motor actually stops, that is, a period during which the toner dispensing motor is still rotating by the rotational inertial force. This overrun time can be predetermined through experiments. In the toner dispense buffering process, although the overrun time is not necessarily included in the subtractive value from the toner dispense buffering time, the overrun time if included may increase the precision of toner density control.

Next, the toner dispense control section 1031 update the toner dispense buffering time (Step S127) by applying the first subtractive value corrected in Step S125 and the second subtractive value corrected in Step S126. Specifically, the first subtractive value corrected in Step S125 and the second subtractive value corrected in Step S126 are added, and the additional value is subtracted from the toner dispense buffering time stored in the memory 1034 at that moment, thereby updating the toner dispense buffering time applied to the toner dispensing operation in the subsequent toner dispensing period. The updated toner dispense buffering time is maintained in the memory 1034.

In the process flow, when the driving speed of the developing motor is set to "high speed," the first subtractive value and the second subtractive value are corrected using the largest coefficient M41. When the driving speed of the developing motor is set to "low speed," the first subtractive value and the second subtractive value are corrected using the smallest coefficient M43.

For this reason, assuming the coefficients are set such that: M41=1.2, M42=1.0, M43=0.8, the subtractive values are corrected in the direction that they increase when the driving speed of the developing motor is set to "high speed," while the subtractive values are corrected in the direction that they decrease when the driving speed of the developing motor is set to "low speed." As a result, in the actual toner dispensing operation, when the driving speed of the developing motor is set to "high speed," the toner dispense driving time is changed so as to be shorter than that of the case of "medium speed," while when the driving speed of the developing motor is set to "low speed," the toner dispense driving time is changed so as to be longer than that of the case of "medium speed."

As a specific example, a case will be considered in which image data, of which the ICDC toner dispense time calculated based on the number of pixels for one page is 1000 msec in common, are continuously processed into the same development color for 10 pages using a developing unit. In this case, it is assumed that a coefficient applied for the driving speed of the developing motor set to "high speed" is set M41=1.2; a coefficient applied for the driving speed of the developing motor set to "medium speed" is set M42=1.0, and a coefficient applied for the driving speed of the developing motor set to "low speed" is set M43=0.8.

In such a case, when the process speed is set to "medium speed," since the ICDC toner dispense time is used, as it is, as the toner dispense driving time in the toner dispense buffering process, the sum of the toner dispense driving time required to process the image data for 10 pages becomes 10000 msec.

In contrast, when the driving speed of the developing motor is set to "high speed" or "slow speed," the toner dispense buffering process is performed following the flow of numeric processing, as shown in FIG. 14. For example, when the driving speed of the developing motor is set to "high speed," regarding the image data of the first page, since the toner dispense buffering time becomes 1000 msec by the addition of the ICDC toner dispense time, the toner dispensing operation is performed twice with a duration of 500 msec. For this reason, the toner dispense driving time becomes 1000 msec, a subtractive value (buffering subtractive value) from the toner dispense buffering time becomes 1200 by the multiplication with a coefficient M41 (=1.2). Therefore, a carry-over time to the subsequent period becomes −200 msec.

Regarding the image data for the second page, of which the driving speed of the developing motor is set to "high speed," since the ICDC toner dispense time for one page is added to the carry-over time from the previous period, the toner dispense buffering time becomes 800 msec, the toner dispensing operation is performed only once with a duration of 500 msec. For this reason, the toner dispense driving time becomes 500 msec, and the subtractive value from the toner dispense buffering time becomes 600 msec by the multiplication with a coefficient M41 (=1.2). Therefore, a carry-over time to the subsequent operation becomes +200 msec.

On the other hand, when the driving speed of the developing motor is set to "low speed," regarding the image data of the first page, since the toner dispense buffering time becomes 1000 msec by the addition of the ICDC toner dispense time, the toner dispensing operation is performed twice with a duration of 500 msec. For this reason, the toner dispense driving time becomes 1000 msec, a subtractive value (buffering subtractive value) from the toner dispense buffering time becomes 800 by the multiplication with a coefficient M43 (=0.8). Therefore, a carry-over time to the subsequent period becomes +200 msec.

Regarding the image data for the second page, of which the driving speed of the developing motor is set to "high speed," since the ICDC toner dispense time for one page is added to the carry-over time from the previous period, the toner dispense buffering time becomes 1200 msec, the toner dispensing operation is performed twice with a duration of 500 msec. For this reason, the toner dispense driving time becomes 1000 msec, and the subtractive value from the toner dispense buffering time becomes 800 msec by the multiplication with a coefficient M43 (=0.8). Therefore, a carry-over time to the subsequent operation becomes +400 msec.

As a result, the sum of the toner dispense driving time required to process 10 pages becomes 8500 msec (850 msec on average for one page) for the driving speed of the developing motor set to "high speed." The sum of the toner dispense driving time required to process 10 pages becomes 10000 msec (1000 msec on average for one page) for the driving speed of the developing motor set to "medium speed." the sum of the toner dispense driving time required to process 10 pages becomes 12000 msec (1200 msec on average for one page) for the driving speed of the developing motor set to "low speed."

For the sake of explanation, it is assumed that the toner dispense rate is 1.2 mg/sec for the driving speed of the developing motor set to "high speed"; the toner dispense rate is 1.0 mg/sec for the driving speed of the developing motor set to "medium speed"; and the toner dispense rate is 0.8 mg/sec for the driving speed of the developing motor set to "low speed." In such a case, in view of the fact that in the process flow shown in FIG. 11, the driving speed of the toner dispensing motor is set to "high speed" when the driving speed of the developing motor is set to "high speed"; the driving speed of the toner dispensing motor is set to "medium speed" when the driving speed of the developing motor is set to "medium speed"; and the driving speed of the toner dispensing motor is set to "low speed" when the driving speed of the developing motor is set to "low speed," in the above example, the sum of the toner dispense amount for 10 pages becomes 10.2 mg (1.02 mg on average for one page) for the driving speed of the toner dispensing motor set to "high speed"; the sum of the toner dispense amount for 10 pages becomes 10 mg (1 mg on average for one page) for the driving speed of the toner dispensing motor set to "medium speed"; and the sum of the toner dispense amount for 10 pages becomes 9.6 mg (0.96 mg on average for one page) for the driving speed of the toner dispensing motor set to "low speed."

In contrast, for example, assuming that the coefficients M41, M42, and M43 are all set to 1.0, the sum of the toner dispense driving time required to process the image data for 10 pages becomes 10000 msec (1000 msec on average for one page) regardless of the driving speed of the developing motor. For this reason, the sum of the toner dispense amount for 10 pages becomes 12 mg (1.2 mg on average for one page) for the driving speed of the developing motor set to "high speed"; the sum of the toner dispense amount for 10 pages becomes 10 mg (1 mg on average for one page) for the driving speed of the developing motor set to "medium speed"; and the sum of the toner dispense amount for 10 pages becomes 8.0 mg (0.8 mg on average for one page) for the driving speed of the developing motor set to "low speed."

Therefore, when image data for one page, of which the number of pixels counted by the pixel counter 1032 is the same, are printed on a sheet under a different condition of the driving speed of the developing motor, even when the toner dispense rate varies with the differing driving speed of the toner dispensing motor, the toner dispense amount for one page is equalized regardless of the driving speed of the toner dispensing motor by changing the toner dispense driving time according to the process flow shown in FIG. 13.

Modified Example of the Third Embodiment

As a modified example of the present invention, in the case in which the toner dispense control section 1031 performs the toner dispense buffering process based on the process flow shown in FIG. 13, the upper limit of the toner dispense driving time that is permitted for one toner dispensing period may be changed in accordance with the driving speed of the developing motor. The upper limit of the toner dispense driving time may be changed by changing at least one of the value of t and the value of n when the toner dispensing operation is performed a maximum of n times (n: an integer not less than 2) with a duration of t within the one toner dispensing period.

That is, by fixing the value of t and setting the value of n so as to be relatively great, the upper limit of the toner dispense driving time is changed in the direction that it increases, while by setting the value of n so as to be relatively small, the upper limit of the toner dispense driving time is changed in the direction that it decreases. By fixing the value of n and setting the value of t so as to be relatively great, the upper limit of the toner dispense driving time is changed in the direction that it increases, while by setting the value of t so as to be relatively small, the upper limit of the toner dispense driving time is changed in the direction that it decreases. By setting the values of t and n so as to be relatively great, the upper limit of the toner dispense driving time is changed in the direction that it increases, while by setting the values of t and n so as to be relatively small, the upper limit of the toner dispense driving time is changed in the direction that it decreases.

Figure 15:
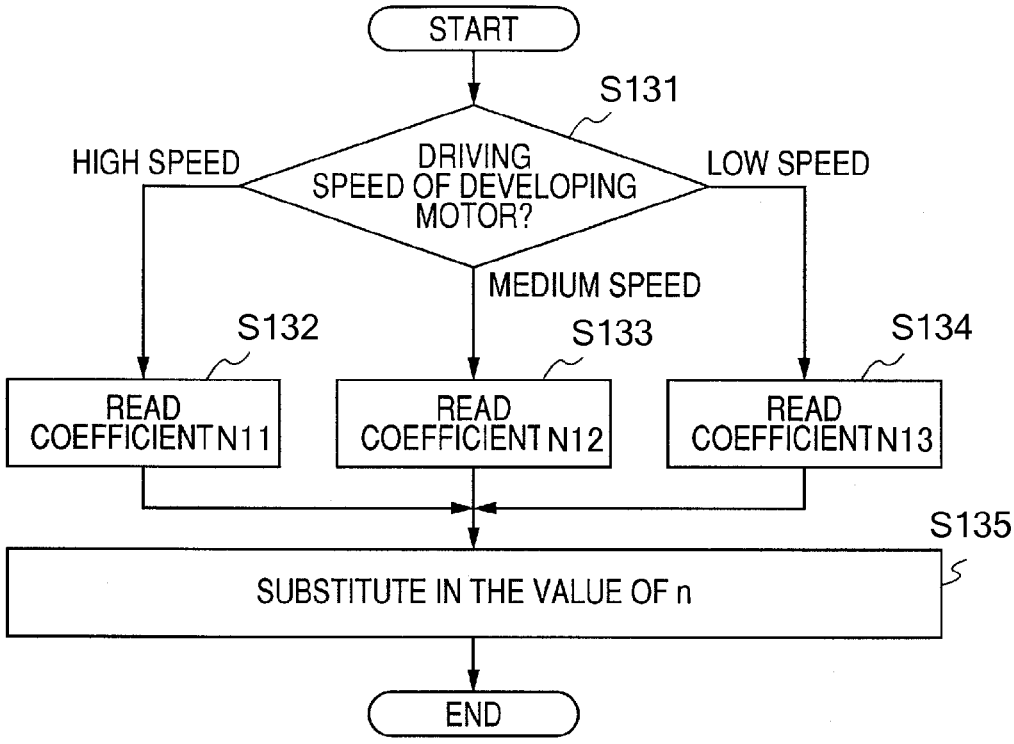
FIG. 15 is a flow chart showing the process according to a modified example of the third embodiment of the present invention.

FIG. 15 is a flow chart showing the procedure of the toner dispense control process applied for the case of changing the upper limit of the toner dispense driving time in accordance with the driving speed of the developing motor. First, the toner dispense control section 1031 determines whether the driving speed of the developing motor notified from the developing motor control section 1037 (or an image forming control section) is set to "high speed," "medium speed," or "low speed" (Step S131).

When it is determined in step S131 that the driving speed of the developing motor is set to "high speed," a value N11 of a toner dispensing operation inhibiting number stored in the memory 1034 to correspond to the speed setting of "high speed" is read (Step S132). When it is determined that the driving speed of the developing motor is set to "medium speed," a value N12 of the toner dispensing operation inhibiting number stored in the memory 1034 to correspond to the speed setting of "medium speed" is read (Step S133). When it is determined that the driving speed of the developing motor is set to "low speed," a value N13 of the toner dispensing operation inhibiting number stored in the memory 1034 to correspond to the speed setting of "low speed" is read (Step S134). These three coefficients N11, N12, and N13 are all natural numbers and set to satisfy a magnitude relationship: "N11<N12<N13."

Next, the toner dispense control section 1031 substitutes the value of n in the value of N11, N12, or N13 read in Step S132, S133, or S134 (Step S135). With this process flow, the value of n is changed in accordance with the driving speed of the developing motor.

In the process flow shown in FIG. 15, since the three values N11, N12, and N13 are set to satisfy the magnitude relationship: "N11<N12<N13," when the driving speed of the developing motor is set to "high speed," the toner dispensing operation inhibiting number is smaller than that of the case of "medium speed," while when the driving speed of the developing motor is set to "low speed," the toner dispensing operation inhibiting number is greater than that of the case of "medium speed." Therefore, when the driving speed of the developing motor is set to "high speed," the upper limit of the toner dispense driving time is changed so as to be smaller than that of the case of "medium speed," while when the driving speed of the developing motor is set to "low speed," the upper limit of the toner dispense driving time is changed so as to be greater than that of the case of "medium speed."

Figure 16:
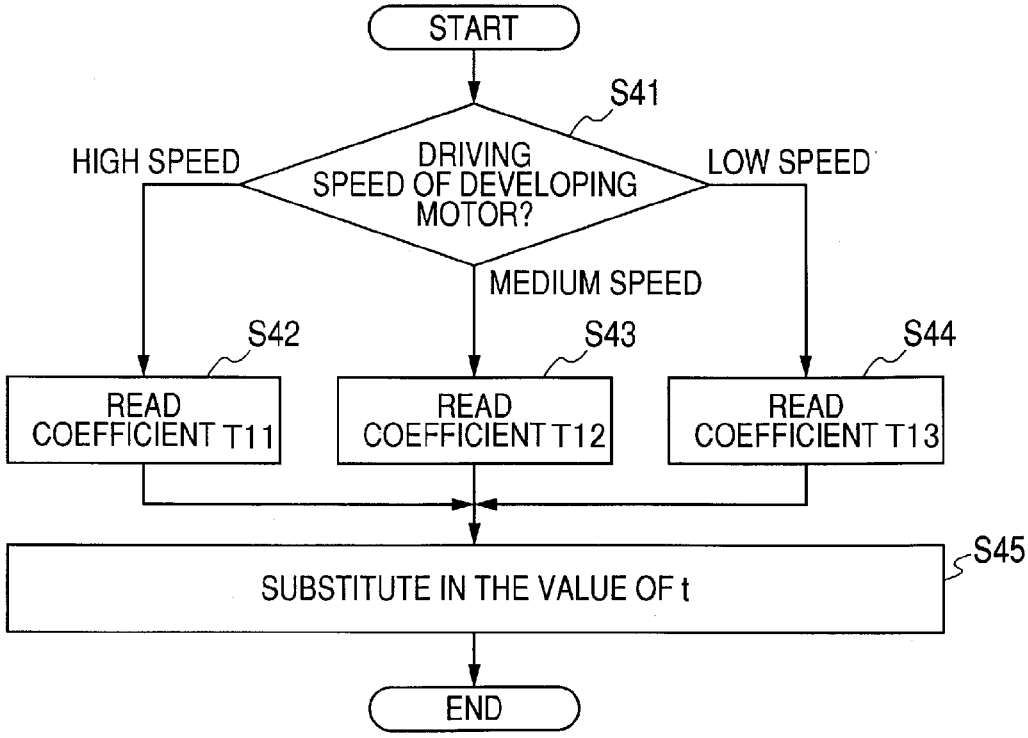
FIG. 16 is a flow chart showing the process according to a modified example of the third embodiment of the present invention.

In the process flow shown in FIG. 15, although the value of n is changed in accordance with the driving speed of the developing motor, the value of t may be changed instead of changing the value of n. The process flow for such a case corresponds to the procedure of steps S41 to S45 shown in FIG. 16. In this case, even when any one of the values of n and t is changed, as the driving speed of the developing motor increases, the upper limit of the toner dispense driving time is changed in the direction that it decreases. For this reason, in the process flow of FIG. 16, the values T11, T12, and T13 of a unit toner dispense driving time read from the memory 1034 in Step S42, S43, or S44 are set to satisfy the magnitude relationship: "T11<T12<T13."

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image carrying member;

a developing unit that develops an electrostatic latent image formed on the image carrying member using toner;

a toner dispensing unit that dispenses the toner to the developing unit; and a toner dispense control unit that controls the toner dispensing unit in accordance with an operation speed of the developing unit or the image carrying member.

2. The image forming apparatus as claimed in claim 1, further comprising:

a driving source that is common to the developing unit and the toner dispensing unit.

3. The image forming apparatus as claimed in claim 1, wherein the toner dispense control unit changes a driving time of the toner dispensing unit in accordance with the operation speed of the image carrying member.

4. The image forming apparatus as claimed in claim 1, wherein the toner dispense control unit changes a driving time of the toner dispensing unit so as to be relatively short in a case where the operation speed of the image carrying member is relatively high, and changes the driving time of the toner dispensing unit so as to be relatively long in a case where the operation speed of the image carrying member is relatively low.

5. The image forming apparatus as claimed in claim 1, wherein the toner dispense control unit switches a coefficient to be multiplied with a toner dispense time in accordance with the operation speed of the image carrying member, the toner dispense time being calculated based on toner density control information.

6. The image forming apparatus as claimed in claim 1, wherein in a case where a toner dispense buffering process is performed such that a toner dispense time calculated based on toner density control information is used as an additional value to a toner dispense buffering time and that a driving time of the toner dispensing unit is used as a subtractive value from the toner dispense buffering time, the toner dispense control unit switches a coefficient to be multiplied with the subtractive value in accordance with the operation speed of the image carrying member.

7. The image forming apparatus as claimed in claim 1, wherein the toner dispense control unit changes an upper limit of a toner dispense driving time that is permitted for one developing period in accordance with the operation speed of the image carrying member.

8. The image forming apparatus as claimed in claim 7, wherein when a toner dispensing operation is performed a maximum of n times with a duration of t within the one developing period, the toner dispense control unit changes at least one of the value of t and the value of n in accordance with the operation speed of the image carrying member, n being a natural number not less than 2.

9. The image forming apparatus as claimed in claim 1, wherein the toner dispense control unit comprises a speed control unit that changes an operation speed of the toner dispensing unit in accordance with the operation speed of the developing unit.

10. The image forming apparatus as claimed in claim 9, wherein the toner dispense control unit changes a driving time of the toner dispensing unit in accordance with the operation speed of the developing unit.

11. The image forming apparatus as claimed in claim 10, wherein the toner dispense control unit changes the driving time of the toner dispensing unit so as to be relatively short in a case where the operation speed of the developing unit is relatively high, and changes the driving time of the toner dispensing unit so as to be relatively long in a case where the operation speed of the developing unit is relatively low.

12. The image forming apparatus as claimed in claim 10, wherein the toner dispense control unit switches a coefficient to be multiplied with a toner dispense time in accordance with the operation speed of the developing unit, the toner dispense time being calculated based on toner density control information.

13. The image forming apparatus as claimed in claim 10, wherein in a case where a toner dispense buffering process is performed such that a toner dispense time calculated based on the toner density control information is used as an additional value to a toner dispense buffering time and that the driving time of the toner dispensing unit is used as a subtractive value from the toner dispense buffering time, the toner dispense control unit switches a coefficient to be multiplied with the subtractive value in accordance with the operation speed of the developing unit.

14. The image forming apparatus as claimed in claim 10, wherein the toner dispense control unit changes an upper limit of a toner dispense driving time that is permitted for one developing period in accordance with the operation speed of the developing unit.

15. The image forming apparatus as claimed in claim 14, wherein in a case where a toner dispensing operation is performed n times at maximum with a duration of t within the one developing period, the toner dispense control unit changes at least one of the value of t and the value of n in accordance with the operation speed of the image carrying member, n being a natural number not less than 2.

* * * * *